US011553760B2

(12) United States Patent
Hatfield et al.

(10) Patent No.: US 11,553,760 B2
(45) Date of Patent: Jan. 17, 2023

(54) CLOSURE STRAP FOR FOOTWEAR UPPER WITH LOOPED GRAB HANDLE

(71) Applicant: NIKE, Inc., Beaverton, OR (US)

(72) Inventors: Tobie D. Hatfield, Lake Oswego, OR (US); Eric P. Avar, Lake Oswego, OR (US); Ross Klein, Portland, OR (US); Jeffrey C. Spanks, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 157 days.

(21) Appl. No.: 16/904,854

(22) Filed: Jun. 18, 2020

(65) Prior Publication Data

US 2021/0022449 A1 Jan. 28, 2021

Related U.S. Application Data

(60) Provisional application No. 62/878,858, filed on Jul. 26, 2019.

(51) Int. Cl.
*A43C 11/00* (2006.01)
*A43B 23/02* (2006.01)

(52) U.S. Cl.
CPC ..... *A43C 11/00* (2013.01); *A43B 23/0295* (2013.01)

(58) Field of Classification Search
CPC . A43C 11/00; A43C 11/1493; A43B 23/0295; A43B 1/0081; A43B 11/00
See application file for complete search history.

(56) References Cited

U.S. PATENT DOCUMENTS

| | | | |
|---|---|---|---|
| 913,012 | A | 2/1909 | Jackson |
| 1,088,067 | A | 2/1914 | Forbes |
| 1,649,173 | A | 11/1927 | McDonough |
| 1,700,569 | A | 1/1929 | Hillery |
| 1,894,939 | A | 1/1933 | Brown et al. |
| 1,976,819 | A | 10/1934 | Weiler |
| 2,266,083 | A | 12/1941 | Rzepa |
| 3,192,651 | A | 7/1965 | Smith |
| 3,913,243 | A | 10/1975 | Arnold et al. |
| 4,079,527 | A | 3/1978 | Antonious |

(Continued)

FOREIGN PATENT DOCUMENTS

| | | | |
|---|---|---|---|
| AU | 2010202361 | A1 | 7/2010 |
| CA | 1141535 | A | 2/1983 |

(Continued)

*Primary Examiner* — Shaun R Hurley
*Assistant Examiner* — Bao-Thieu L Nguyen
(74) *Attorney, Agent, or Firm* — Quinn IP Law

(57) ABSTRACT

An article of footwear includes a sole structure and an upper. The upper may include a first and a second section and partially define a foot-receiving cavity over the sole structure. The first section may be fixed to the sole structure and the second section may articulate between an access position and a use position. The foot-receiving cavity may be more exposed in the access position to allow easier foot entry. A strap may extend from one of the first and the second section. A looped handle may extend from the strap and may at least partially form a loop. The strap may extend across the second section of the upper when the second section is in the use position. The strap may have a distal portion configured to releasably secure to one of the first section or the second section with the looped handle exposed.

17 Claims, 14 Drawing Sheets

(56) References Cited

U.S. PATENT DOCUMENTS 4,081,916 A 4/1978 Salisbury
4,114,297 A 9/1978 Famolare, Jr.
4,282,657 A 8/1981 Antonious
4,308,672 A 1/1982 Antonious
4,451,995 A 6/1984 Antonious
4,486,965 A 12/1984 Friton
4,640,025 A 2/1987 DeRenzo
4,860,464 A 8/1989 Misevich et al.
4,972,613 A * 11/1990 Loveder ..... A43B 5/00 36/105
5,027,482 A * 7/1991 Torppey ..... A43C 11/1493 24/712.1
5,074,059 A 12/1991 Melcher
D346,479 S 5/1994 Teague
5,557,866 A * 9/1996 Prengler ..... A43B 5/00 36/138
5,755,044 A * 5/1998 Veylupek ..... A43C 3/00 36/50.1
5,794,360 A 8/1998 Bell et al.
5,813,144 A * 9/1998 Prengler ..... A43B 13/203 36/71
5,819,439 A 10/1998 Sanchez
6,594,921 B2 7/2003 Laio et al.
6,832,442 B2 12/2004 Lewis et al.
6,941,683 B2 9/2005 Freed
6,996,922 B2 2/2006 Ryoo
7,200,957 B2 4/2007 Hubbard et al.
7,490,417 B2 2/2009 Petrie
7,874,997 B2 1/2011 Jaccard
8,898,936 B1 12/2014 Thompson-Boothe et al.
9,119,436 B1 * 9/2015 Ardell ..... A43B 5/06
9,144,262 B2 * 9/2015 Ardell ..... A43B 23/0295
9,392,838 B2 * 7/2016 Fischer ..... A43B 5/1666
9,516,920 B1 * 12/2016 DeRose ..... A43B 3/26
9,526,300 B2 12/2016 Krengel
9,723,891 B2 8/2017 Xanthos et al.
9,730,492 B2 8/2017 Krengel
9,907,364 B1 3/2018 Bosserman
D814,169 S 4/2018 Ngene
10,136,694 B2 * 11/2018 Fischer ..... A43B 5/1666
10,602,802 B2 * 3/2020 Hopkins ..... A43B 3/248
11,026,473 B2 * 6/2021 Berns ..... A61F 13/066
2002/0020078 A1 2/2002 Bressoux et al.
2002/0050076 A1 * 5/2002 Borsoi ..... A43C 1/00 36/88
2002/0095823 A1 7/2002 Laio et al.
2002/0133974 A1 9/2002 Bartolini
2002/0166260 A1 11/2002 Borsoi
2003/0051374 A1 3/2003 Freed
2003/0167655 A1 9/2003 Sussmann
2004/0078999 A1 4/2004 Freed
2008/0168683 A1 7/2008 Keating
2008/0196212 A1 * 8/2008 Nelson ..... A43B 1/0081 24/72.1
2009/0076428 A1 * 3/2009 Kay ..... A61F 5/0111 602/27
2009/0100649 A1 * 4/2009 Bar ..... A43C 11/14 24/306
2009/0100707 A1 4/2009 Bar et al.
2009/0293240 A1 * 12/2009 Hubbard ..... A43B 1/0081 24/712.1
2009/0300947 A1 12/2009 Babolat
2010/0036304 A1 * 2/2010 Norton ..... A43C 11/1493 602/65
2010/0154256 A1 6/2010 Dua
2010/0199522 A1 * 8/2010 Hwang ..... A43B 23/047 36/102
2010/0319216 A1 * 12/2010 Grenzke ..... A43B 11/00 36/50.1
2011/0271556 A1 11/2011 Dillenbeck
2012/0023783 A1 * 2/2012 Nichols ..... A43B 5/14 36/131
2012/0079746 A1 4/2012 Ferreira et al.
2014/0096415 A1 4/2014 Long
2014/0196311 A1 7/2014 Follet et al.
2014/0196317 A1 * 7/2014 Katz ..... A43B 23/07 36/89
2014/0360049 A1 * 12/2014 Panian ..... A43B 11/00 36/83
2015/0216252 A1 * 8/2015 Wiens ..... A43B 1/0054 36/105
2015/0223554 A1 * 8/2015 Ardell ..... A43C 15/005 36/105
2015/0374065 A1 * 12/2015 DiFrancisco ..... A43B 3/30 36/105
2016/0081421 A1 * 3/2016 Fischer ..... A43B 5/18 36/72 A
2016/0270484 A1 * 9/2016 Zadnik ..... A43C 11/00
2016/0302530 A1 10/2016 Smith et al.
2016/0309831 A1 * 10/2016 Fischer ..... A43B 5/16
2018/0116343 A1 * 5/2018 Hei ..... A43C 11/00
2018/0199659 A1 * 7/2018 Lintaman ..... A43C 1/006
2018/0213882 A1 * 8/2018 Morse ..... A43B 23/0295
2018/0242692 A1 8/2018 Houng et al.
2018/0263332 A1 * 9/2018 Bruno ..... A43C 11/008
2018/0289100 A1 10/2018 Bell et al.
2018/0295942 A1 10/2018 Drake
2018/0338562 A1 11/2018 Hatfield et al.
2019/0021447 A1 * 1/2019 Whewell ..... A43B 23/0235
2019/0059483 A1 2/2019 Anceresi et al.
2019/0313741 A1 10/2019 Bell et al.
2019/0313742 A1 10/2019 Bell et al.
2020/0323308 A1 * 10/2020 Dubuisson ..... A43B 9/00
2021/0186146 A1 * 6/2021 Erwin ..... A43B 23/0245

FOREIGN PATENT DOCUMENTS

CN 102970889 A 3/2013
CN 105188452 A 12/2015
CN 205611886 U 10/2016
CN 106136418 A 11/2016
DE 10208853 C1 6/2003
EP 0252517 A2 1/1988
FR 3046915 A1 7/2017
JP H10179210 A 7/1998
KR 200355597 Y1 7/2004
TW M261248 U 4/2005

* cited by examiner

CLOSURE STRAP FOR FOOTWEAR UPPER WITH LOOPED GRAB HANDLE

CROSS-REFERENCE TO RELATED APPLICATION

This application claims the benefit of U.S. Provisional Application No. 62/878,858, filed Jul. 26, 2019, which is hereby incorporated by reference in its entirety.

TECHNICAL FIELD

The present teachings generally include footwear having an upper configured for easy foot insertion.

BACKGROUND

Footwear may include a sole structure configured to be located under a wearer's foot to space the foot away from the ground. A footwear upper attached to the sole structure receives the foot. The fit of the upper to the foot may be adjusted with a fastening system so that the upper is loose enough to receive the foot but can be tightened around the foot to secure the foot relative to the sole structure. For example, a closure system, such as a lacing system, may include laces that are tied once the foot is received within the upper. Traditionally, placing footwear on a foot often requires the use of one or both hands to stretch the ankle opening of an upper, and hold the rear portion during foot insertion. The fit of the upper is then adjusted following foot insertion, such as by tying laces.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
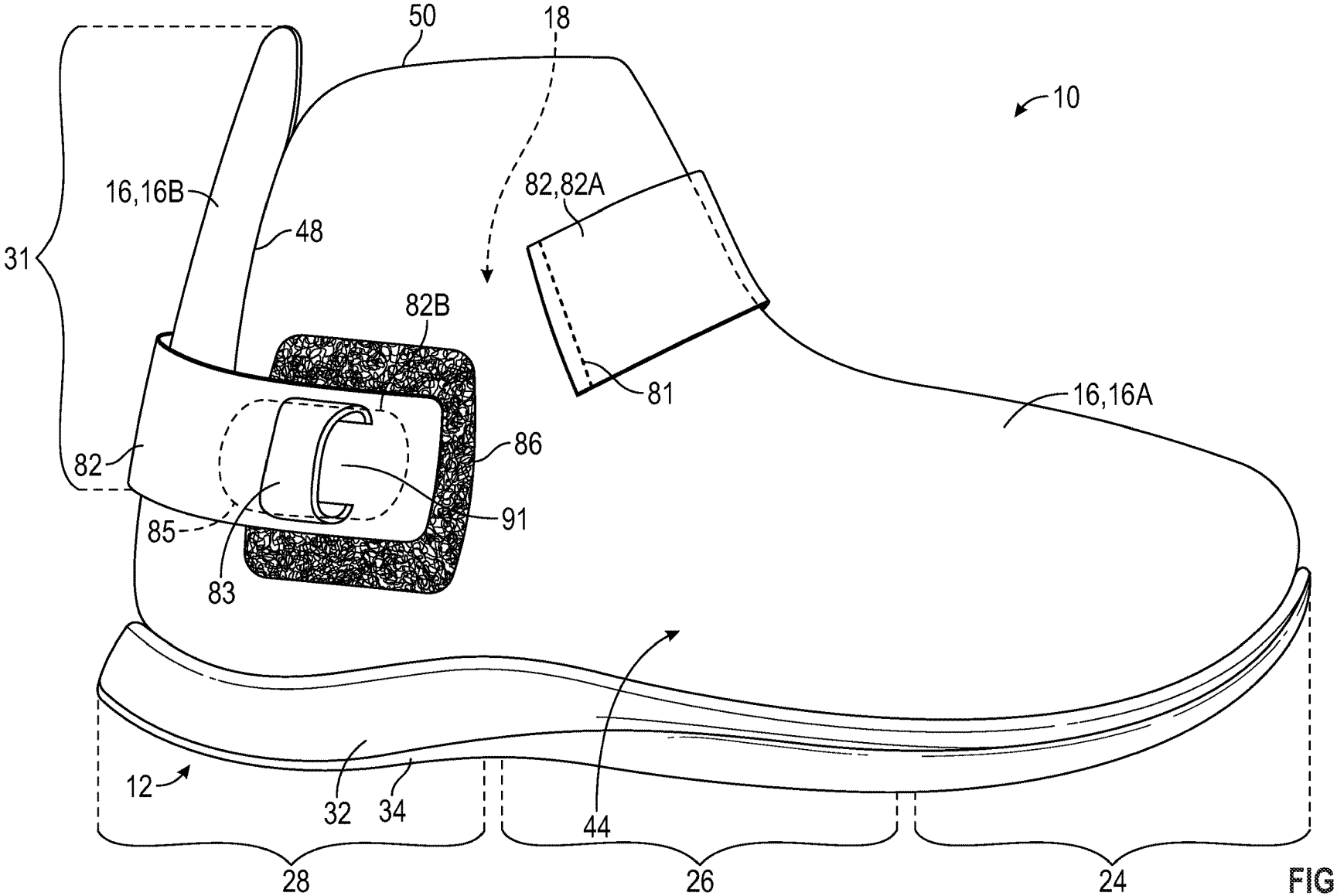
FIG. 1 is a medial side view of an article of footwear with a rear section of the upper in a use position and a strap with a looped handle in a secured position.

The present disclosure generally relates to an article of footwear. Various footwear embodiments are disclosed having features that enable foot insertion and securement quickly, with relative ease, and with less manual dexterity necessary than for footwear that requires manually stretching a throat area to enlarge a foot opening and/or that requires securement by tightening and tying a lace. More specifically, an upper has a section that articulates between an access position and a use position. The access position allows easy foot entry. A strap extends from the footwear and has a looped handle for easy manipulation of the strap to a secured position to help support the articulating section of the upper in the use position.

In an example, an article of footwear comprises a sole structure and an upper. The upper may include a first section and a second section and may partially define a foot-receiving cavity over the sole structure. The first section may be fixed to the sole structure and the second section may articulate between an access position and a use position. The foot-receiving cavity may be more exposed in the access position than in the use position to allow easier foot entry. A strap may extend from one of the first section and the second section. A looped handle may extend from the strap and may at least partially form a loop. The looped handle may also be referred to as a loop or a grab handle. The strap extends across the second section of the upper when the second section is in the use position. Stated differently, the strap is sufficiently long to extend across an exterior of the second section (e.g., wrap around the rear of the second section). The strap may have a distal portion configured to releasably secure to one of the first section or the second section with the looped handle exposed. The looped handle thus makes securement and release of the strap easier to accomplish with less manual dexterity than would be necessary for a strap without a looped handle. For example, to release a strap without a looped handle from a releasably secured position on the upper, the strap would need to be pulled or peeled away from the upper by gripping its edges which may require relatively strong and nimble fingers. In contrast, the strap with a looped handle may be manipulated by extending one or more fingers into the opening formed by the looped handle and moving the strap by moving the hand while the fingers are extended into the looped handle without necessarily gripping the looped handle. Either orientation of the looped tab may be more advantageous for different users depending on their particular physical abilities.

In an aspect, the looped handle may be attached to the strap at a first location and at a second location spaced apart from the first location and may extend between the first location and the second location (e.g., from the first location to the second location) without connection to the strap. Stated differently, the looped handle may be spaced apart from and not connected to the strap everywhere between the first location and the second location. The looped handle may extend along the length of the strap from the first location to the second location, and an opening formed by the looped handle and the strap between the first location and the second location may extend perpendicular to the length of the strap. In other embodiments, the looped handle may extend along the width of the strap from the first location to the second location, and an opening formed by the looped handle and the strap between the first location and the second location may extend along the length of the strap (e.g., parallel to the length of the strap).

In another aspect, the distal portion of the strap may releasably secure to one of the first section or the second section nearer to a distal end of the strap than to a proximal end of the strap. The looped handle may be disposed nearer to the distal end of the strap than to the proximal end of the strap.

In another aspect, a first fastener portion may be secured to the strap nearer to the distal end of the strap than to the proximal end of the strap, and a second fastener portion may be secured to the one of the first section or the second section of the upper. The first fastener portion may be configured to releasably secure to the second fastener portion. In one or more configurations, the first fastener portion may be secured to an inner side of the strap and the looped handle may be secured to an outer side of the strap. For example, the first fastener portion may be secured to the strap directly opposite from the looped handle. This allows a hand manipulating the strap by the looped handle to press the strap against the upper at the first fastener portion to secure the strap without moving the hand out of the looped handle.

In one or more configurations, a width of the strap between an upper edge of the strap and a lower edge of the strap varies between the distal end and the proximal end of the strap. For example, the strap may be wider at an intermediate portion of the strap than between the proximal end and the intermediate portion and than between the distal end and the intermediate portion. In one or more embodiments, the strap may be convex along the upper edge of the strap at the intermediate portion and convex along the lower edge of the strap at the intermediate portion. Furthermore, the intermediate portion of the strap may be disposed against the second section of the upper when the strap is releasably secured to the one of the first section or the second section. Accordingly, the widest portion of the strap supports the second section in the use position, providing additional stability.

In an aspect, a series of fasteners may be spaced apart from one another along an inner side of the strap. The series of fasteners along the inner side of the strap may be configured as elongated strips disposed with lengths of the elongated strips extending perpendicular to a length of the strap where the length of the strap runs from the proximal end to the distal end of the strap. An exterior surface of the second section of the upper may comprise a hook-and-loop material and the series of fasteners may be hook-and-loop fasteners configured to secure to the hook-and-loop material of the second section.

In another aspect, the upper may define a medial slit and a lateral slit both bounding the second section and both extending downward from an upper edge of the upper partway to the sole structure. The strap may extend across the medial slit and the lateral slit when releasably secured to the first section of the upper.

In still another aspect, the second section may have a fold region extending across the second section between a lowest extent of the medial slit and a lowest extent of the lateral slit. The second section may be thinner at the fold region than above the fold region and than below the fold region, and the second section may articulate at the fold region from the use position to the access position.

In one or more embodiments, the first section may be a front section fixed to a forefoot region of the sole structure, and the second section may be disposed at a heel region of the sole structure at least partially rearward of the first section.

In one or more configurations, a plurality of tensioning cables may be fixed to at least one of the upper or the sole structure at the first side of the first section and may extend out of the first section of the upper and be secured to the strap. A plurality of looped cables may be fixed to at least one of the upper or the sole structure at the second side of the first section. The plurality of tensioning cables may extend through the plurality of looped cables. The strap may be non-releasably connected to the upper only by the plurality of cables.

In one or more embodiments, a fastener may be disposed at the first side of the first section of the upper (e.g. at the lateral side). The strap may be configured to releasably secure to the fastener at the first side of the first section to maintain tension in the tensioning cables prior to releasably securing to the second side of the first section (e.g., to the medial side).

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 shows an article of footwear 10 that has a sole structure 12 and an upper 16 secured to the sole structure 12. The upper 16 forms a foot-receiving cavity 18 configured to receive a foot 20 (shown in phantom in FIG. 2 moving in the direction of arrow A) without manually stretching the upper 16 to enlarge an opening of the foot-receiving cavity 18. As discussed herein, a strap 82 has a looped handle 83 that enables easier routing and securing of the strap 82 to the upper to help support the upper 16.

The footwear 10 illustrated herein is depicted as an athletic shoe configured for sports such as basketball, but the footwear 10 is not limited to basketball shoes or other sports shoes. The footwear 10 may be a leisure shoe, a dress shoe, a work shoe, a sandal, a slipper, a boot, or any other category of footwear. As indicated in FIG. 1, the footwear 10 may be divided into a forefoot region 24, a midfoot region 26, a heel region 28, which are also the forefoot region, the midfoot region, and the heel region, respectively, of the sole structure 12 and the upper 16, and with an ankle region 31 defined by the upper 16. The forefoot region 24 generally includes portions of the article of footwear 10 corresponding with the toes and the joints connecting the metatarsals with the phalanges. The midfoot region 26 generally includes portions of the article of footwear 10 corresponding with the arch area and instep of the foot, and the heel region 28 corresponds with rear portions of the foot, including the calcaneus bone. The ankle region 31 corresponds with the ankle. The forefoot region 24, the midfoot region 26, the heel region 28, and the ankle region 31 are not intended to demarcate precise areas of the footwear 10 but are instead intended to represent general areas of the footwear 10 to aid in the following discussion.

The sole structure 12 includes a midsole 32 and an outsole 34. The midsole 32 may be formed from a compressible polymer foam element (e.g., a polyurethane or ethylvinylacetate foam) that attenuates ground reaction forces (i.e., provides cushioning) when compressed between the foot 20 and the ground during walking, running, or other ambulatory activities. The midsole 32 may incorporate fluid-filled chambers, plates, moderators, or other elements that further attenuate forces, enhance stability, or influence the motions of the foot 20. The midsole 32 may be a single, one-piece midsole, or could be multiple components integrated as a unit. In some embodiments, the midsole 32 may be integrated with the outsole 34 as a unisole. The outsole 34 may be one-piece, or may be several outsole components, and in one example may be formed from a wear-resistant rubber material that may be textured to impart traction and/or may include traction elements such as cleats secured to the midsole 32.

Figure 2:
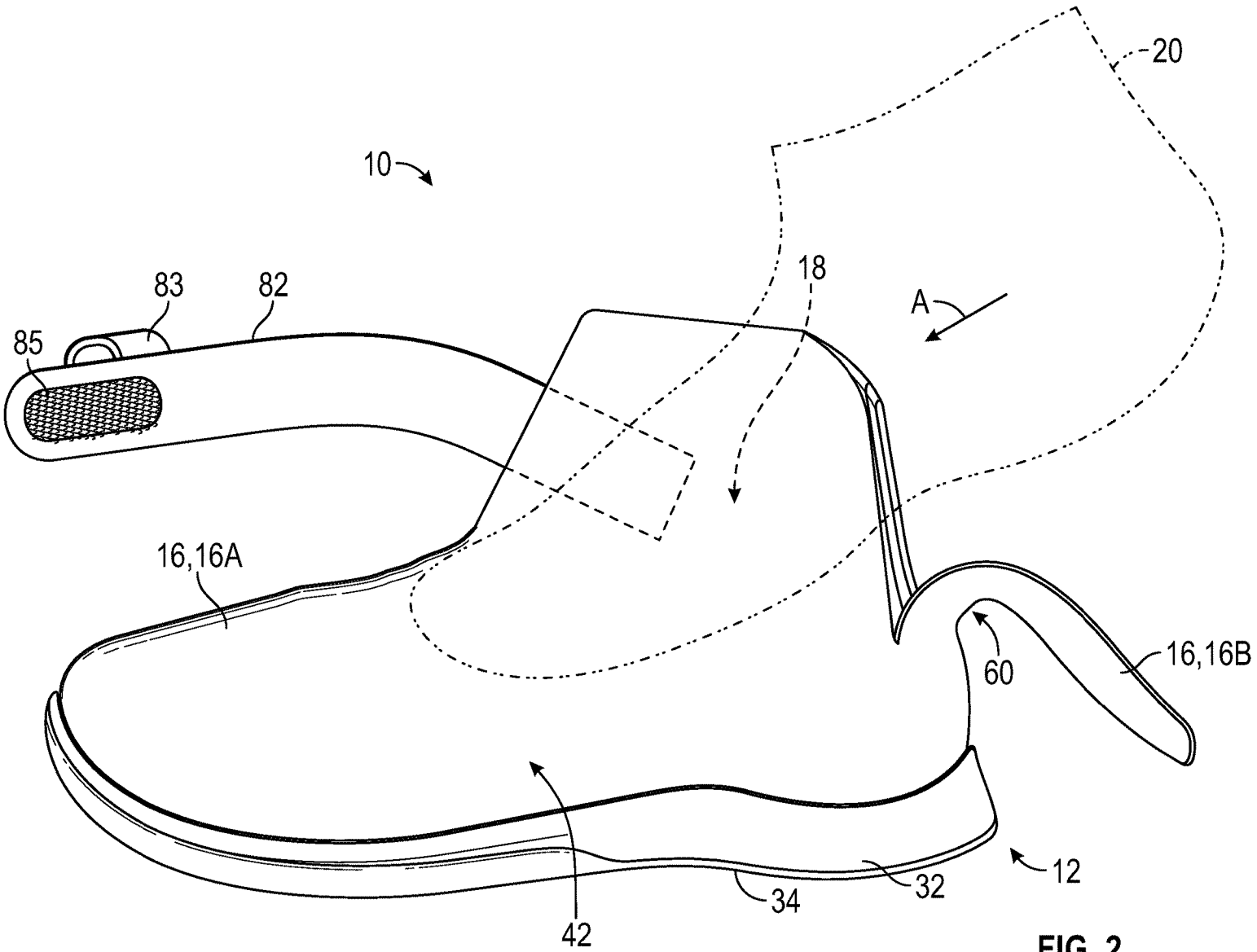
FIG. 2 is a lateral side view of the article of footwear of FIG. 1 with the rear section of the upper in an access position, the strap in an unsecured position, and a foot shown in phantom entering a foot-receiving cavity of the article of footwear.

The upper 16 includes a first section 16A, also referred to herein as a front section 16A, and a second section 16B, also referred to herein as a rear section. In the embodiment of FIGS. 1-4, the rear section 16B is configured to articulate relative to the front section 16A and the sections 16A and 16B are configured to cooperate so that the rear section 16B is movable between a use position (FIG. 1) and an access position (FIG. 2). The movement between the positions may be accomplished in a hands-free manner or manually. For example, a wearer may use their hand or either foot to articulate the rear section 16B to the access position prior to inserting their foot 20 into the foot-receiving cavity 18. For example, a wearer may use their hand to grip or otherwise engage a looped tab 52 extending from the rear section 16B to articulate the rear section 16B to the access position. The wearer's entering foot 20 may brush against the inner side of the articulated rear section 16B, causing the rear section 16B to articulate back to the use position. The wearer may manually move the rear section 16B from one position to the other, or the wearer's other foot can be used to move the rear section 16B from the access position to the use position. The use position may be maintained solely via a bias of the rear section 16B to the use position and/or by securement of a strap 82, or snaps, zippers, buttons or other fasteners (not shown). The rear section 16B may be biased to the use position shown by internal forces of the materials comprising the various layers of the rear section 16B being lower in the use position than when the rear section 16B is folded at the fold region 60. Accordingly, the bias urges the rear section 16B to articulate back to the use position. Although the second section (rear section 16B) is shown as being disposed in the heel region rearward of the first section (front section 16A), in other embodiments, the articulating second section could be disposed at the medial side 44 or at the lateral side 42 of the footwear, or could be disclosed at the front of the footwear.

When the foot 20 is positioned within the foot-receiving cavity 18 of the footwear 10, it is supported on a foot-facing surface of the midsole 32. The foot-facing surface of the midsole 32 may be covered by a strobel (not shown) secured to a lower region of the upper 16. Also, an insole (not shown) may rest on the strobel or directly on the sole structure 12 in embodiments without a strobel, in which case the foot 20 is supported by both the sole structure 12 and the insole.

The footwear 10 has a lateral side 42 (shown in FIG. 2) and a medial side 44 (shown in FIG. 1). The lateral side 42 may be referred to as a first side, and the medial side 44 may be referred to as a second side, or vice versa. The lateral side 42 and medial side 44 extend through each of the forefoot region 24, the midfoot region 26, the heel region 28, and the ankle region 31, and correspond with opposite sides of the article of footwear 10, each falling on an opposite side of a longitudinal midline of the article of footwear 10, as is understood by those skilled in the art. The medial side 44 is thus considered opposite to the lateral side 42.

The upper 16 may be a variety of materials, such as leather, textiles, polymers, cotton, foam, composites, etc. The front section 16A may include a material that has greater elasticity, greater breathability, or both greater elasticity and greater breathability than the material or materials of the rear section 16B to aid with foot insertion and comfort. The rear section 16B may include one or more materials that are stiffer than the front section 16A to provide stability in the heel region 28. For example, the front section 16A may be a polymeric material capable of providing elasticity, and may be of a braided construction, a knitted (e.g., warp-knitted) construction, or a woven construction.

The front section 16A and the rear section 16B are integral portions of the upper 16, with the rear section 16B defined as being bound by a lateral slit 46 in the upper 16 (FIG. 3) and a medial slit 48 in the upper 16 (FIG. 1), both slits 46, 48 bounding the rear section 16B and both extending downward from an upper extent 50 of the upper 16 partway to the sole structure 12.

Figure 3:
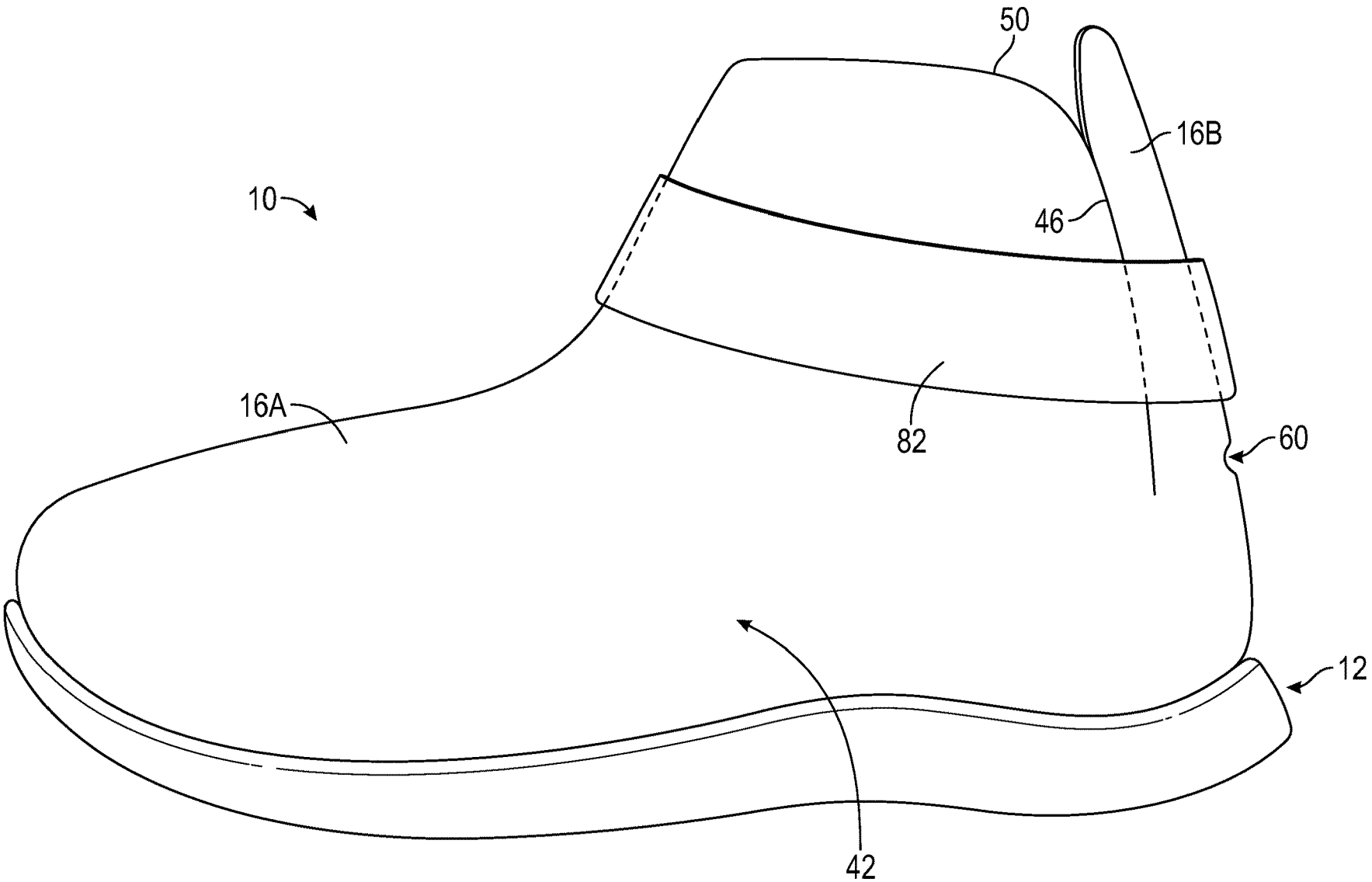
FIG. 3 is a lateral side view of the article of footwear of FIG. 1 with the rear section of the upper in the use position and the strap in the secured position.

The rear section 16B is configured as a living hinge in order to allow the use of relatively thick materials in the rear section 16B while still allowing articulation. More specifically, with reference to FIG. 2, the rear section 16B has a fold region 60 at which the rear section 16B articulates to the access position. As shown in FIG. 3, the rear section 16B is thinner at the fold region 60 than above the fold region 60 and than below the fold region 60 and therefore defines a living hinge at the fold region 60. For example, with reference to FIG. 4, padding 62 (indicated in hidden lines) may be disposed above the fold region 60 between an outer layer and an inner layer of the rear section 16B or internal or external to the remaining layers of the rear section 16B. Additionally padding 65 or a stiffening heel counter may be disposed below the fold region 60 and between the outer layer and the inner layer. The padding 62, 65 may be thicker than the fold region 60, which may be free from padding or may have thinner padding.

A strap 82 is used to help secure the rear section 16B in the use position. FIGS. 1 and 3 show the medial side 44 of the footwear 10 with the rear section 16B in the use position and the strap 82 wrapped across the front section 16A from the medial side 44 to the lateral side 46 and then continuing around the rear section 16B from the lateral side 46 to the medial side 44. Snaps, zippers, buttons, or other fasteners (not shown) may extend between the rear section 16B and the front section 16A at the slits 46, 48 to secure the rear section 16B in the use position. In another variation, a portion of the rear section 16B and the front section 16A may overlap at the slits 46, 48 and may be include hook-and-loop material to secure the rear section 16B in the use position.

The strap 82 has a looped handle 83 secured to an exterior surface 84 (the outer side) of the strap 82. In the embodiment shown, the looped handle 83 is secured to an exterior surface 84 of the strap 82. In other embodiments, the looped handle 83 may be secured to an inner surface (the inner side or the interior side) of the strap 82 and still extend outward of the exterior surface 84. For example, the ends of the looped handle 83 may extend from the outer side to the inner side over the top and bottom edges of the strap 82.

The strap 82 has a proximal portion 82A (also referred to as a proximal end) secured to the front section 16A at the medial side 44 such as with stitching 81 as shown in FIG. 1. The strap 82 extends from the medial side 44 of the front section 16A around the lateral side 42 and across the rear section 16B back to the medial side 44 and has a distal portion 82B (also referred to as a distal end) releasably securable to the front section 16A of the upper 16 also at the medial side 44 (e.g., at the same side from which it extends). The looped handle 83 extends from an outer side of the strap 82 nearer the distal end 82B than the proximal end 82A and at least partially forms a loop. The looped handle 83 is secured to the outer side of the strap 82 (e.g., the exterior surface 84 of the strap 82) and may be gripped by the wearer to assist with easy moving of the strap 82. The looped handle 83 is attached to the strap 82 at a first location and at a second location spaced apart from the first location. The looped handle 83 may be attached to the strap 82 at the locations such as by stitching. The looped handle 83 extends along the width of the strap 82 between the first location and the second location (e.g., from the first location to the second location) without connection to the strap 82 between the locations so that an opening 91 is formed between the handle 83 and the strap 82, the opening 91 extending along the length of the strap 82 (e.g., parallel to the length of the strap 82), the handle 83 at least partially forming a loop with the strap 82.

A fastener portion 85 (shown only with hidden lines) such as a hook-and-loop fastener may be secured at the inner side of the strap 82 opposite to the looped handle 83. When the rear section 16B is in the use position and the strap 82 is secured as in FIG. 1, the strap 82 extends across the lateral slit 46, the rear section 16B, and the medial slit 48. A fastener portion 86 to which the fastener portion 85 is configured to secure may be secured to the front section 16A at the medial side 44. After insertion of the foot 20 and return of the rear section 16B to the use position, the strap 82 is configured to and is sufficiently long so that it may be wrapped across the back of the rear section 16B from the lateral side 42 to the medial side 44. The fastener portion 85 may secure to the fastener portion 86 as shown in FIG. 1 by a single pressing motion of the distal portion 82B toward the front section 16A and may release from the medial side 44 of the front section 16A via a single peeling motion away from the upper 16.

Alternatively, in another embodiment, the strap 82 could extend from the lateral side 42, wrap across the rear section 16B and secure to the lateral side 42. Still further, the proximal portion 82A of the strap 82 could be secured to the rear section 16B, and the strap 82 could wrap around the front section 16A from one of the lateral side and the medial side to the other of the lateral side and the medial side.

Figure 4:
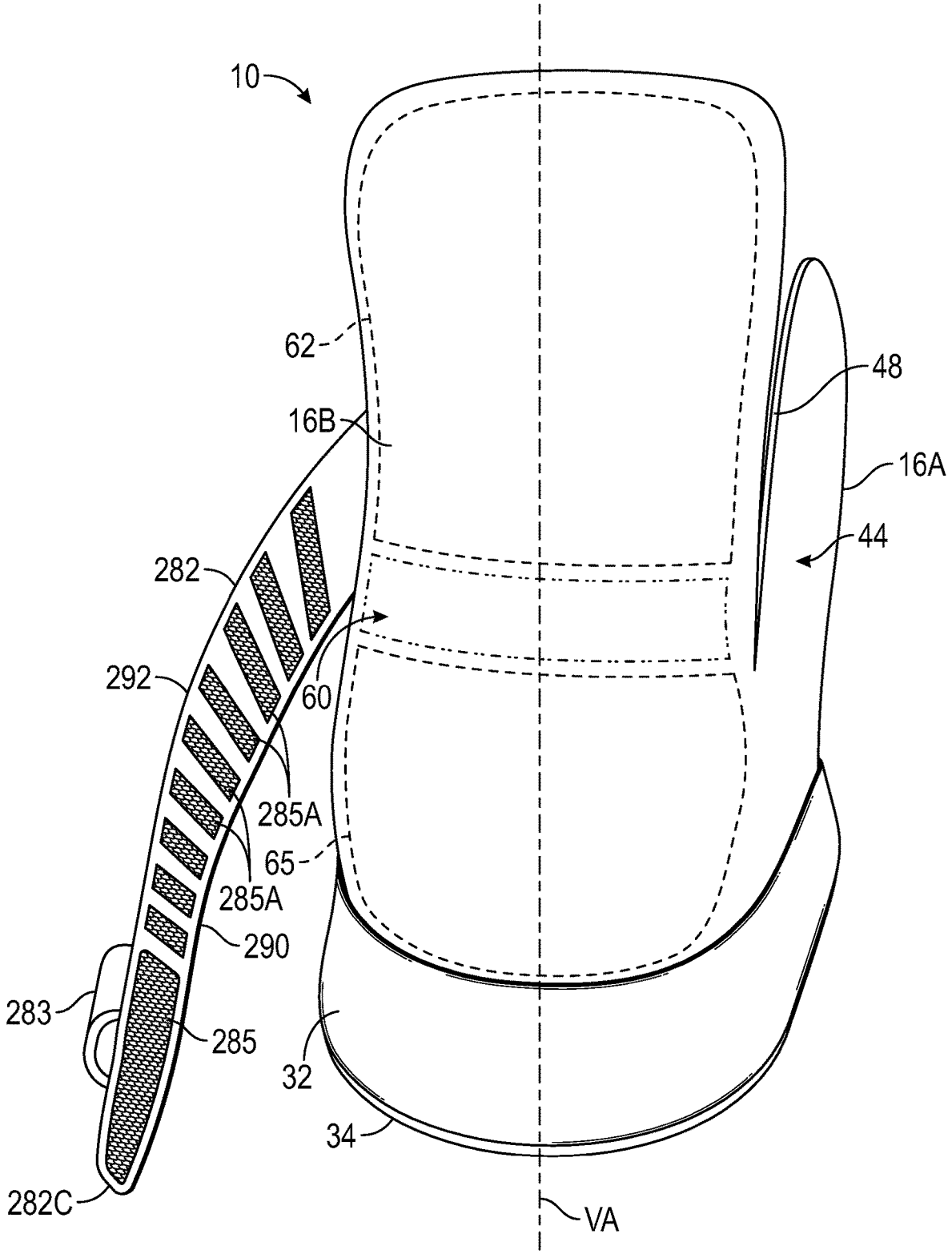
FIG. 4 is a rear perspective view of the article of footwear of FIG. 1 with the rear section in the use position and an alternative strap in an unsecured position.
Figure 5:
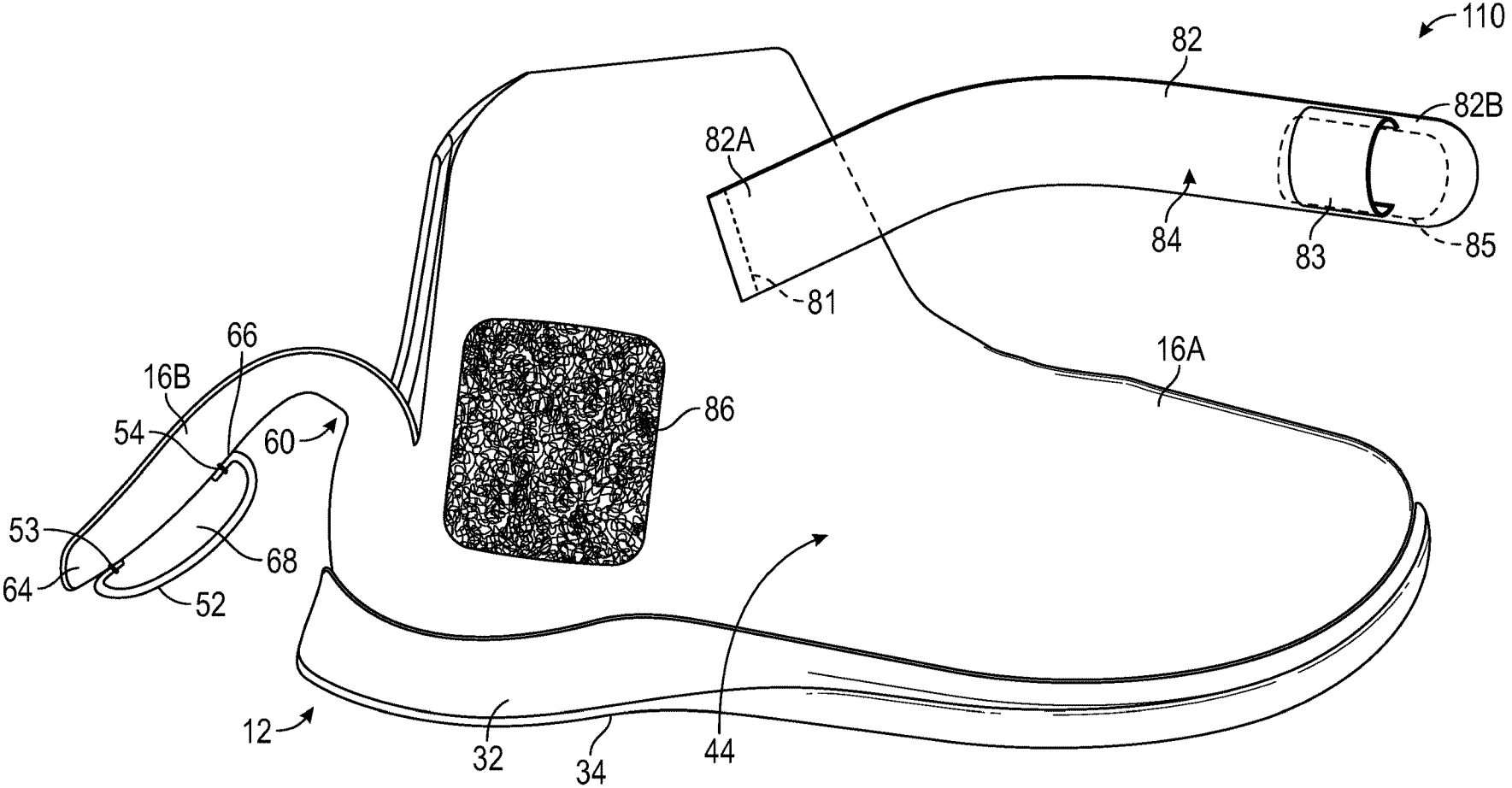
FIG. 5 is a medial side view of an article of footwear with a rear section of the upper in the access position and a strap in an unsecured position, in accordance with an alternative aspect of the present teachings.
Figure 9:
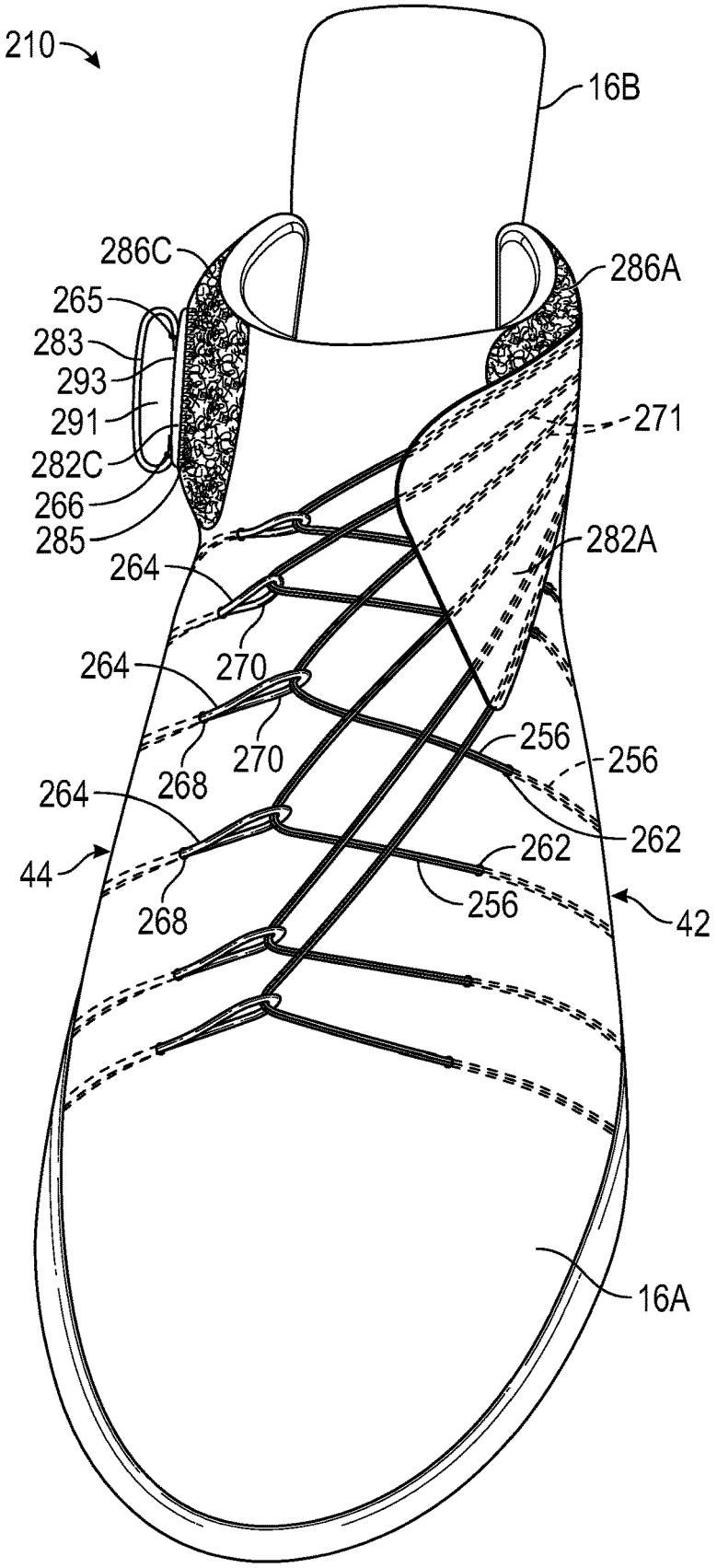
FIG. 9 is a front perspective view of the article of footwear of FIG. 7 with the rear section of the upper in the use position and the strap in a secured position.

FIG. 4 shows the rear of the article of footwear 10 with the fold region 60 horizontally-aligned with a lower extent of the slit 48 (as well as slit 46, not shown). The alternative strap 282 described with respect to FIG. 9 is shown. A looped tab 52 is shown on an alternative article of footwear 110 in FIG. 5. The rear section 16B articulates along the vertical axis VA without moving laterally or with very little lateral movement.

Figure 6:
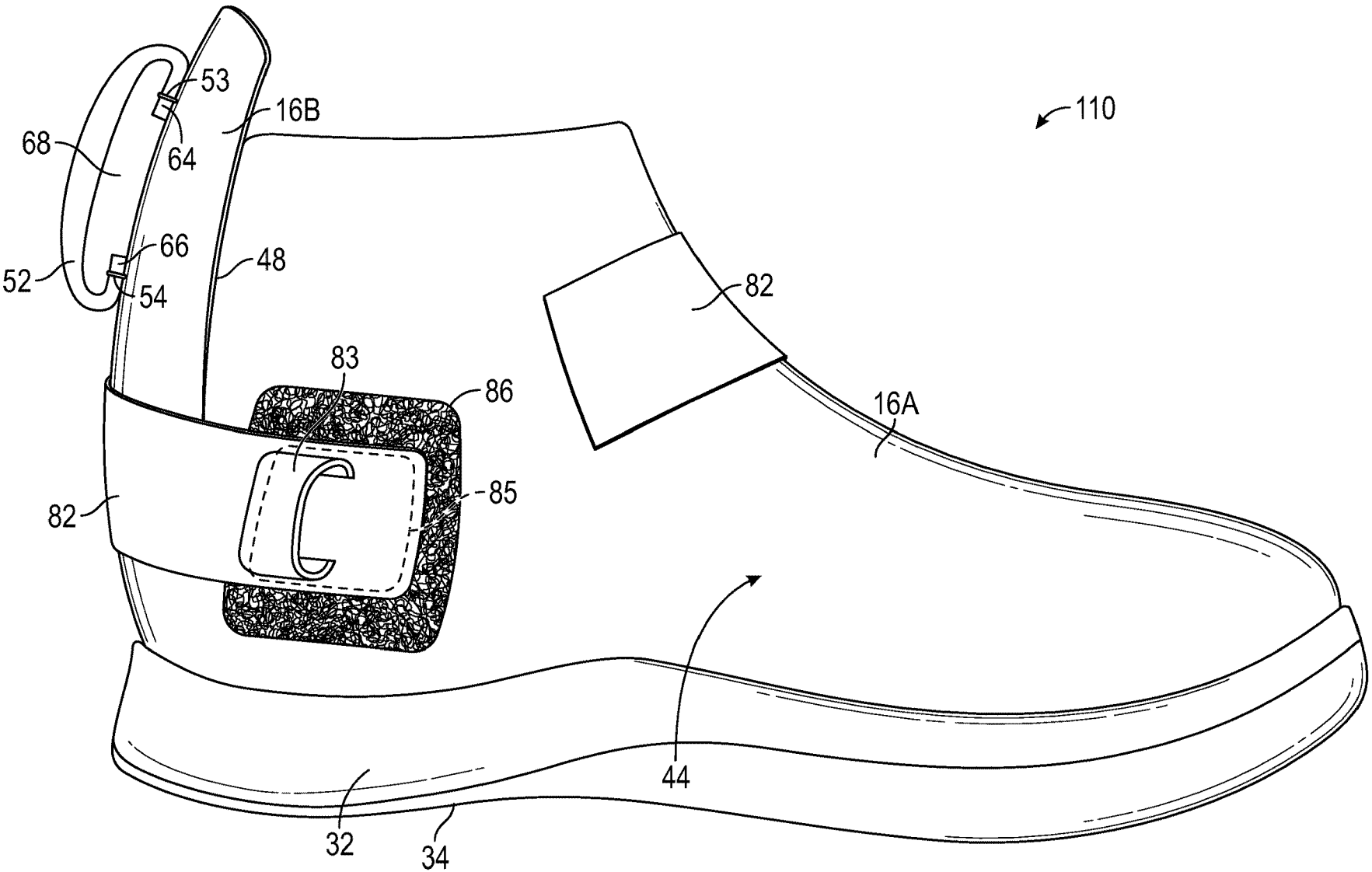
FIG. 6 is a medial side view of the article of footwear of FIG. 5 with the rear section of the upper in the use position and the strap in the secured position.

The looped tab 52 is configured as a heel pull tab and is secured to the rear section 16B. As is apparent in FIG. 6, the looped tab 52 is disposed above the fold region 60 when the rear section 16B is in the use position. The looped tab 52 is attached to the rear section 16B at a first location 64 with stitches 53 or otherwise, and at a second location 66 with stitches 54 of otherwise. The looped tab 52 extends between the first location 64 and the second location 66 without connection to the rear section 16B. Stated differently, the looped tab 52 is spaced apart from the rear section 16B between the first location 64 and the second location 66. The looped tab 52 extends vertically on the rear section 16B between the first location 64 and the second location 66. An opening 68 formed between the looped tab 52 and the rear section 16B extends horizontally (e.g., passes from one side of the looped tab 52 to the other side of the looped tab 52 in a horizontal direction).

In other embodiments, a tab that is not looped could be used in place of the looped tab 52. For example, the tab could be a straight strip anchored only at one end to the rear section 16B. However, looping the tab 52 by attaching it to the rear section 16B at the first location 64 and at the second location 66 may allow for more consistent and easier grabbing of the looped tab 52 and manipulation of the strap 82.

The looped tab 52 may be a flexible, non-stretch material, such as a woven nylon. In the embodiment shown, the looped tab 52 is tubular. For example, ends of the tab 52 may be open to form the tube, but are secured to the rear section 16B and closed by the stitching 53, 54. For this reason, the tab 52 partially forms a loop exterior to the rear section 16B and is referred to as a looped tab. The rear section 16B forms the remainder of the loop.

Figure 7:
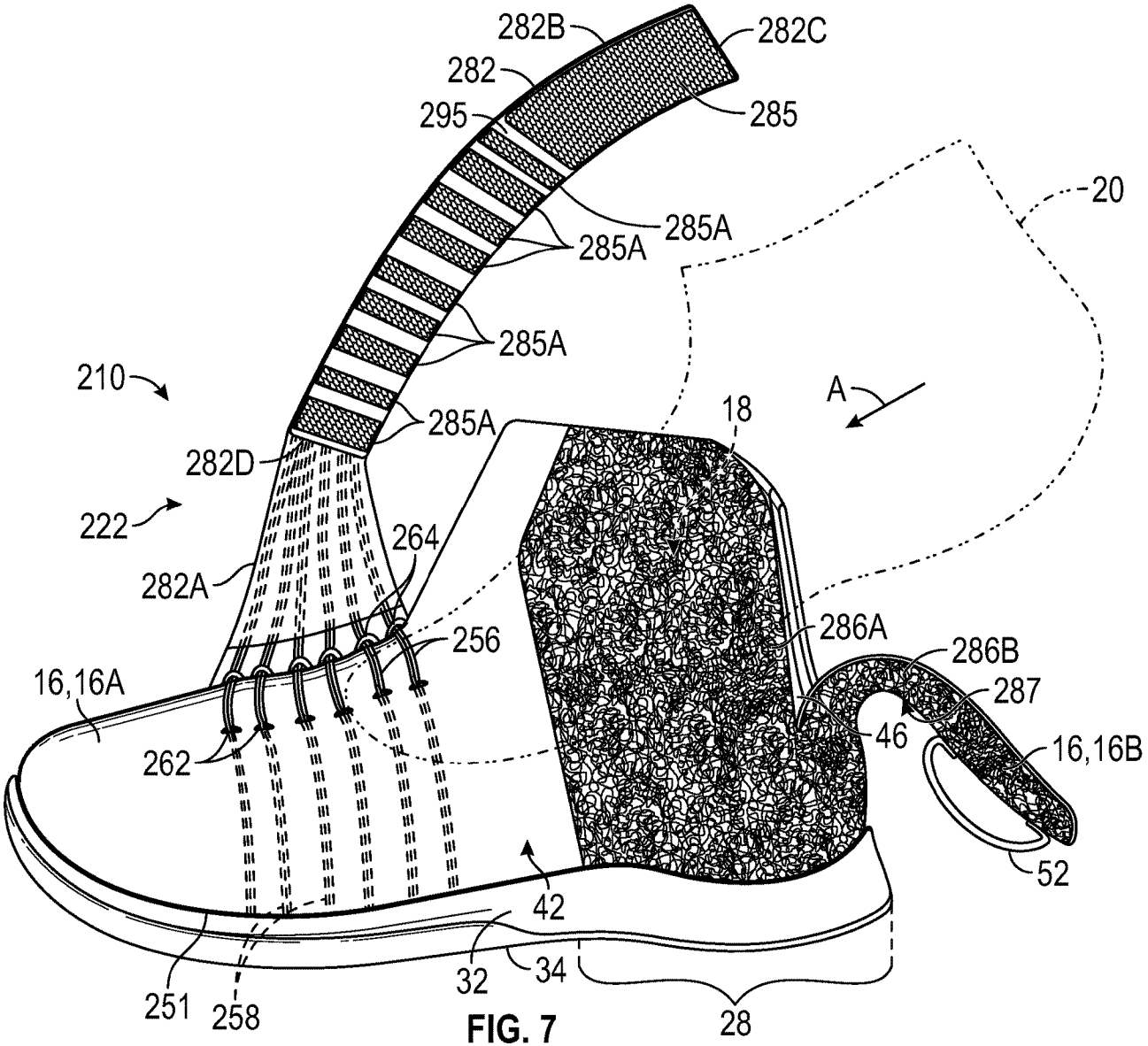
FIG. 7 is a lateral side view of an article of footwear with a rear section of the upper in the access position, a strap in an unsecured position, and a foot shown in phantom entering a foot-receiving cavity of the article of footwear, in accordance with an alternative aspect of the present teachings.
Figure 8:
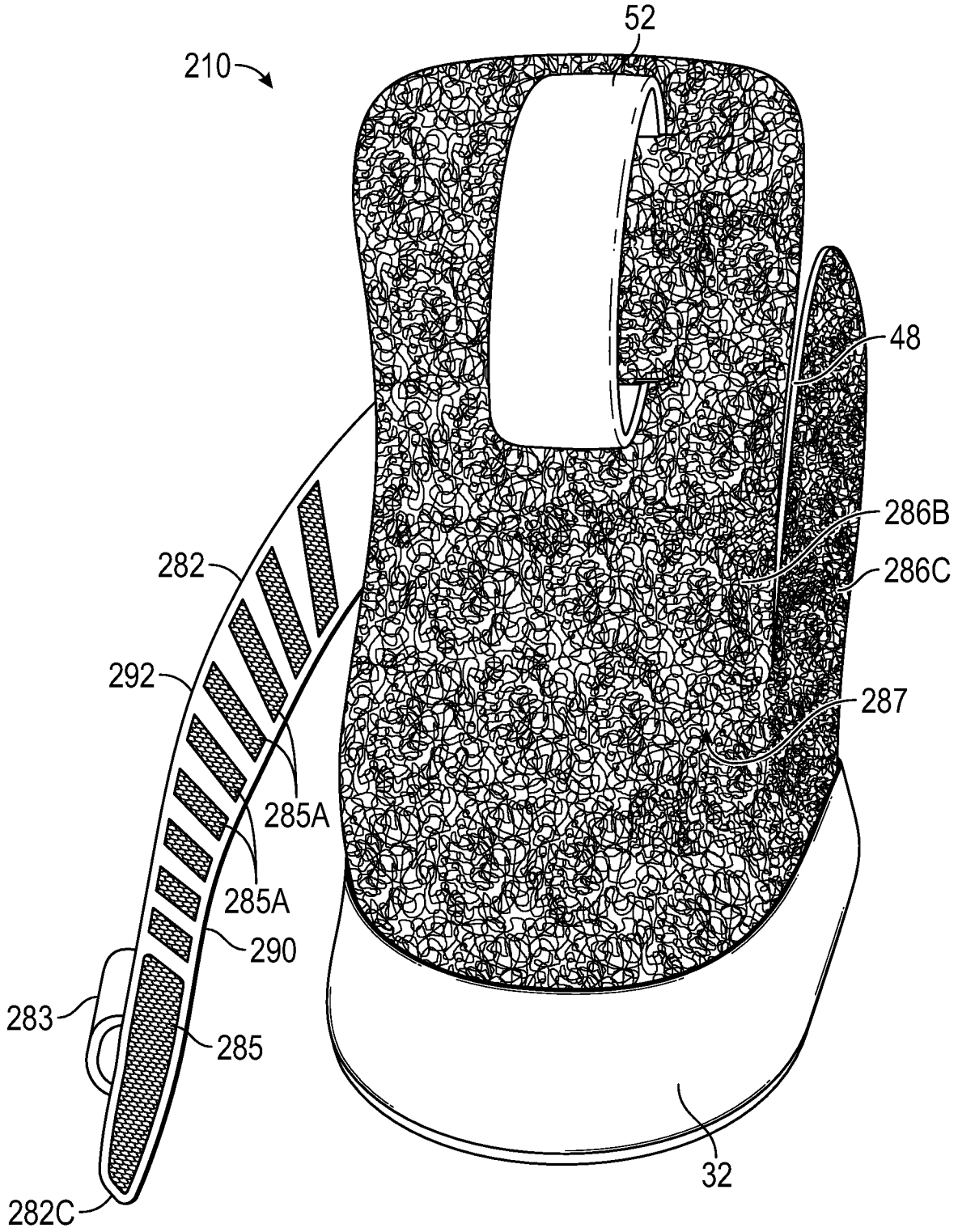
FIG. 8 is a rear perspective view of the article of footwear of FIG. 7 with the rear section of the upper in the use position and the strap in an unsecured position.

FIGS. 7-9 show another embodiment of an article of footwear 210 with an alternative embodiment of a strap 282. Components that are the same as described with respect to the article of footwear 10 or 110 are indicated with like reference numbers. FIG. 7 is a lateral side view of the article of footwear 210 with the rear section 16B of the upper 16 in the access position, the strap 282 in an unsecured position, and a foot 20 shown in phantom entering a foot-receiving cavity 18 of the article of footwear 210.

The article of footwear 210 includes a fastening system 222 that includes the strap 282 as well as cables and fasteners, as discussed herein. The strap 282 has a distal portion 282B that is releasably securable to the medial side 44 of the front section 16A of the upper 16 via a fastener 285 by a single pressing motion of the distal portion 282B toward a fastener 286C (shown in FIGS. 8 and 9) disposed on the front section 16A. The strap releases from the medial side 44 of the front section 16A via a single peeling motion away from the upper 16. The distal portion 282B of the strap is further from the upper 16 than is a proximal portion 282A of the strap 282 when the strap 282 is held outward from the upper 16 as illustrated in FIG. 7.

The fastener 285 may be referred to as a first fastener or a first fastener portion, and the fastener 286C may be referred to as a second fastener or a second fastener portion. As shown in FIG. 9, the strap 282 is thus releasably securable to the front section 16A by the fastener 285 nearer to a distal end 282C of the strap 282 than to the proximal end 282D of the strap 282. The looped handle 283 extends from an outer side 293 of the strap 282 nearer the distal end 282C than the proximal end 282D and at least partially forms a loop. The looped handle 283 is secured to the outer side 293 of the strap 282 (e.g., from the exterior surface of the strap 282) and may be gripped by the wearer to assist with easy moving of the strap 282. As best shown in FIG. 9, the looped handle 283 is attached to the strap 282 at a first location 265 and at a second location 266 spaced apart from the first location 265. The looped handle 283 may be attached to the strap 282 at the locations 265, 266 such as by stitching. The looped handle 283 extends along the width of the strap 282 between the first location 265 and the second location 266 (e.g., from the first location 265 to the second location 266) without connection to the strap 282 between the locations 265, 266 so that an opening 291 is formed between the handle 283 and the strap 282, the opening 291 extending along the length of the strap 282 (e.g., parallel to the length of the strap 282), the handle 283 at least partially forming a loop with the strap 282. The looped handle 283 is disposed opposite from the fastener 285, which is secured to an inner side 295 of the strap 282 as shown in FIG. 7. Stated differently, the looped handle 283 is on the exterior side 293 of the strap 282 and the fastener 285 is on the inner side 295 of the strap 282 directly opposite from the looped handle 283.

The fastening system 222 provides an adjustable, secure fit to tighten the front section 16A around the foot 20 when the rear section 16B is in the access position, to thereby secure the foot 20 relative to the sole structure 12 underlying the upper 16. With reference to FIGS. 7 and 9, the fastening system 222 also includes a first plurality of tensioning cables 256. The tensioning cables 256 may have proximal ends 258 fixed to at least one of the front section 16A or the sole structure 12 on the lateral side 42 near the bite line 251. The strap 282 is non-releasably connected to the upper 16 only by the plurality of tensioning cables 256. The tensioning cables 256 are disposed either within the body of the front section 16A near the proximal ends 258, or are at least inward of an outer surface of the front section 16A until they emerge from the upper 16 at apertures 262 in the front section 16A where the tensioning cables 256 extend out of the front section 16A. For example, the tensioning cables 256 may be disposed between inner and outer layers of the front section 16A or may be disposed in channels integrally woven into or secured to the front section 16A. The securement of the proximal ends 258 and spacing of the apertures 262 ensures that portions of adjacent ones of the tensioning cables 256 between their proximal ends 258 and the apertures 262 do not overlap one another and are spaced apart from one another. Only some of the proximal ends 258, apertures 262, and tensioning cables 256 are indicated with reference numbers.

The fastening system 222 also includes a plurality of looped cables 264, best shown in FIG. 9 where only some of the looped cables 264 are indicated with reference numbers. The looped cables 264 have proximal ends that are fixed to at least one of the front section 16A of the upper 16 or the sole structure 12 on the medial side 44 near the bite line 251. The plurality of tensioning cables 256 extend upward along the lateral side 42 of the front section 16A from the proximal ends 258, and the plurality of looped cables 264 extend upward on the medial side 44 of the front section 16A from their proximal ends.

Similarly to the tensioning cables 256, the looped cables 264 are disposed within the front section 16A or are at least inward of an outer surface of the front section 16A until they emerge from the upper 16 at apertures 268 in the front section 16A where looped ends 270 of the looped cables 264 extend out of the front section 16A. The looped cables 264 may be disposed between inner and outer layers of the body of the front section 16A or may be disposed in channels integrally woven into or secured to the front section 16A. The securement of the proximal ends and spacing of the apertures 268 ensures that portions of adjacent ones of the looped cables 264 between the proximal ends and the apertures 268 do not overlap one another and are spaced apart from one another. The looped end 270 may be a continuous loop of the looped cable 264. Alternatively, the looped end 270 may be achieved by stitching or tying two portions of the cable 264 to one another to form a loop, or by any other means of forming an aperture at the end of the cable 264.

As used herein, a "cable", such as any of the tensioning cables 256 or the looped cables 264, is a flexible, elongated tensile element, and is a structure capable of withstanding a tensile load and includes, but is not limited to, a lace, a strand, a wire, a cord, a thread, or a string, among others. The cables 256, 264 may be located to (a) resist stretching of the upper 16 in specific directions or locations, (b) limit excess movement of the foot relative to the sole structure 12 and the upper 16, (c) ensure that the foot remains properly positioned relative to the sole structure 12 and the upper 16, and/or (d) reinforce locations where forces are concentrated. As non-limiting examples, suitable materials for the cables 256, 264 include various filaments, fibers, yarns, threads, or ropes that are formed from rayon, polyamide, polyester, polyacrylic, silk, cotton, carbon, glass, aramids (e.g., para-aramid fibers and meta-aramid fibers), ultra-high molecular weight polyethylene, liquid crystal polymer, copper, aluminum, or steel.

With continued reference to FIG. 9, the plurality of tensioning cables 256 extends through the plurality of looped cables 264 between the proximal ends 258 of the plurality of tensioning cables 256 and distal portions 271 of the cables 256 which are secured at the proximal portion 282A of the strap 282. Only some of the distal portions 271 are indicated with reference numbers. When the distal end 282B of the strap 282 is secured to the front section 16A as shown in FIG. 9, the plurality of tensioning cables 256 turn in direction at the plurality of looped cables 264, doubling back toward the lateral side 42 from which they originated.

As further discussed herein, fasteners are disposed on the strap 282 and on the upper 16 to provide a desirable combination of support at both the medial side 44 and the lateral side 42 of the front section 16A while still enabling adjustability in tightness and position of the strap 282. More specifically, fasteners 285, 285A are disposed on the strap 282 and fasteners 286A, 286B, 286C (also referred to as hook-and-loop material) are disposed on the upper 16 and cooperate to help releasably secure the strap 282 to the front section 16A and to the rear section 16B so that the strap 282 can maintain the rear section 16B in the use position. The fasteners 285, 285A are secured to the inner side of the strap 282 and may be referred to as a series of fastener portions. Fastener 286A is secured to the lateral side 42 of the front section 16A in the heel region 28 (see FIG. 7), fastener 286B is secured to an exterior surface 287 of the rear section 16B in the heel region 28 (see FIG. 8), and fastener 286C is secured to the medial side 44 of the front section 16A in the heel region 28 (see FIG. 9). The fasteners 285, 285A are configured to secure to the fasteners 286A, 286B, and 286C. In the embodiment shown, the fasteners 285, 285A, 286A, 286B, and 286C are hook-and-loop fasteners. The fasteners 285, 285A may be hooks, and the fasteners 286A, 286B, and 286C may be loops. Alternatively, the fasteners 285, 285A could be loops, and the fasteners 286A, 286B, and 286C could be hooks, some of the fasteners 285, 285A could be hooks and some could be loops, or some of the fasteners 286A, 286B, and 286C could be hooks and others could be loops, or one or more of the fasteners 285, 285A could be a combination of hooks and loops, and one or more of the fasteners 286A, 286B, and 286C could be a combination of hooks and loops. Still further, other types of fasteners could be used, such as snaps, buttons, etc.

As best shown in FIG. 7, the plurality of first fasteners 285 and 285A are spaced along the inner side 295 of the strap 282, which enables a greater variation in positioning of the strap 282 on the upper 16 in the secured state of the strap 282. Spacing multiple first fasteners 285A along the strap 282 may allow greater articulation of the strap 282 if the material of the strap 282 has greater flexibility than the material of the fasteners 285A. Accordingly, the strap 282 will more easily articulate at the spaces between the first fasteners 285A than if the fasteners 285A were not spaced apart from one another. Given that the first fasteners 285A are configured as strips arranged parallel with one another and will extend vertically between a bottom edge 290 of the strap 282 and a top edge 292 of the strap 282 when the strap 282 is releasably secured as shown in FIG. 9, the strap 282 is better able to articulate to extend across the rear of the rear section 16B from the lateral side 42 to the medial side 44.

The strap 282 crosses over the lateral slit 46 and the medial slit 48 when the rear section 16B is in the use position, and the strap 282 is secured at the medial side 44. The strap 282 may be manipulated in one motion to wrap around the rear of the upper 16 in this manner and releasably secure to the medial side 44 to maintain a desired amount of tension in the cables 256 and an associated fit of the upper 16 to the foot 20. Alternatively, the strap 282 may be first pulled to cause a desired degree of tension in the cables 256 and then, while maintaining the pull on the strap 282, may be initially releasably secured only to the fastener 286A at the lateral side 42 to maintain the tension in the cables 256 prior to then wrapping the strap 282 around the rear of the footwear 210 (e.g., across the lateral slit 46, the rear section 16B, and the medial slit 48) and then may be releasably secured to the medial side 44 of the front section 16A at the fastener 286C. FIG. 9 shows where the strap 282 can interface with and attach to the fastener 286A so that it can be initially secured prior to wrapping around the rear section 16B and further securing to the fasteners 286B and 286C.

Figure 10:
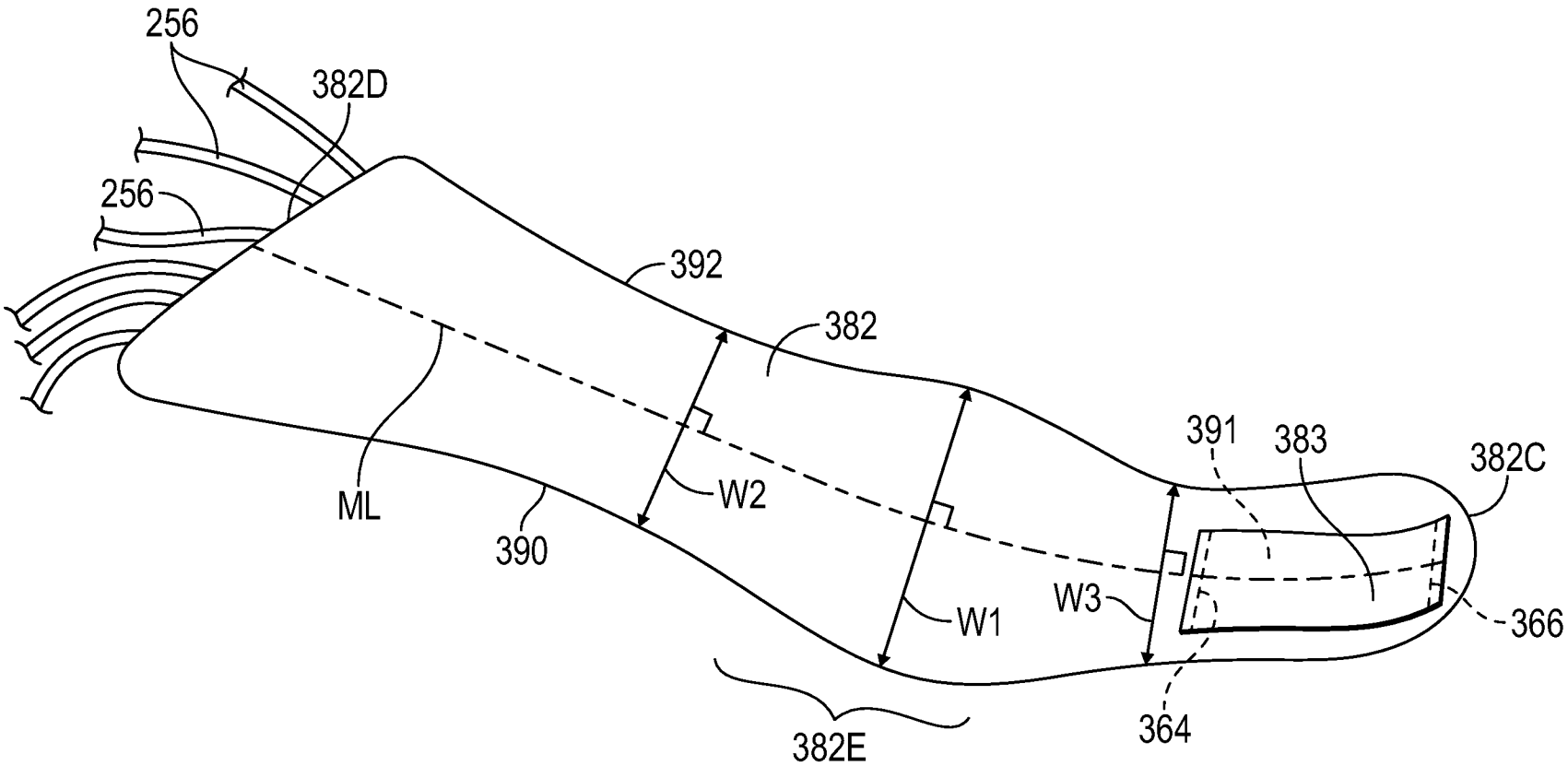
FIG. 10 is a plan view of an outer side of an alternative strap for an article of footwear showing attached tensioning cables in fragmentary view.
Figure 11:
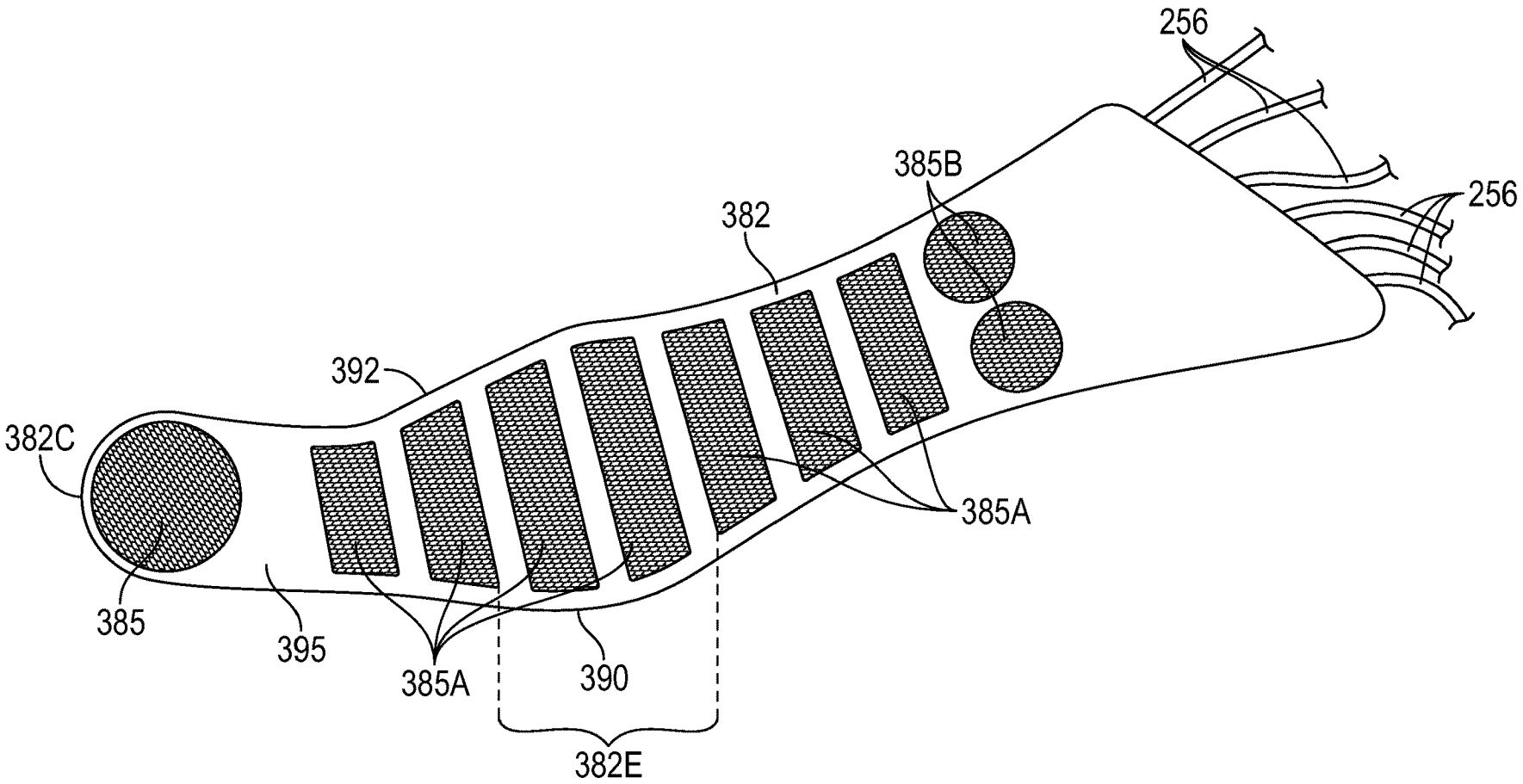
FIG. 11 is a plan view of an inner side of the alternative strap of FIG. 10 showing attached tensioning cables in fragmentary view.
Figure 12:
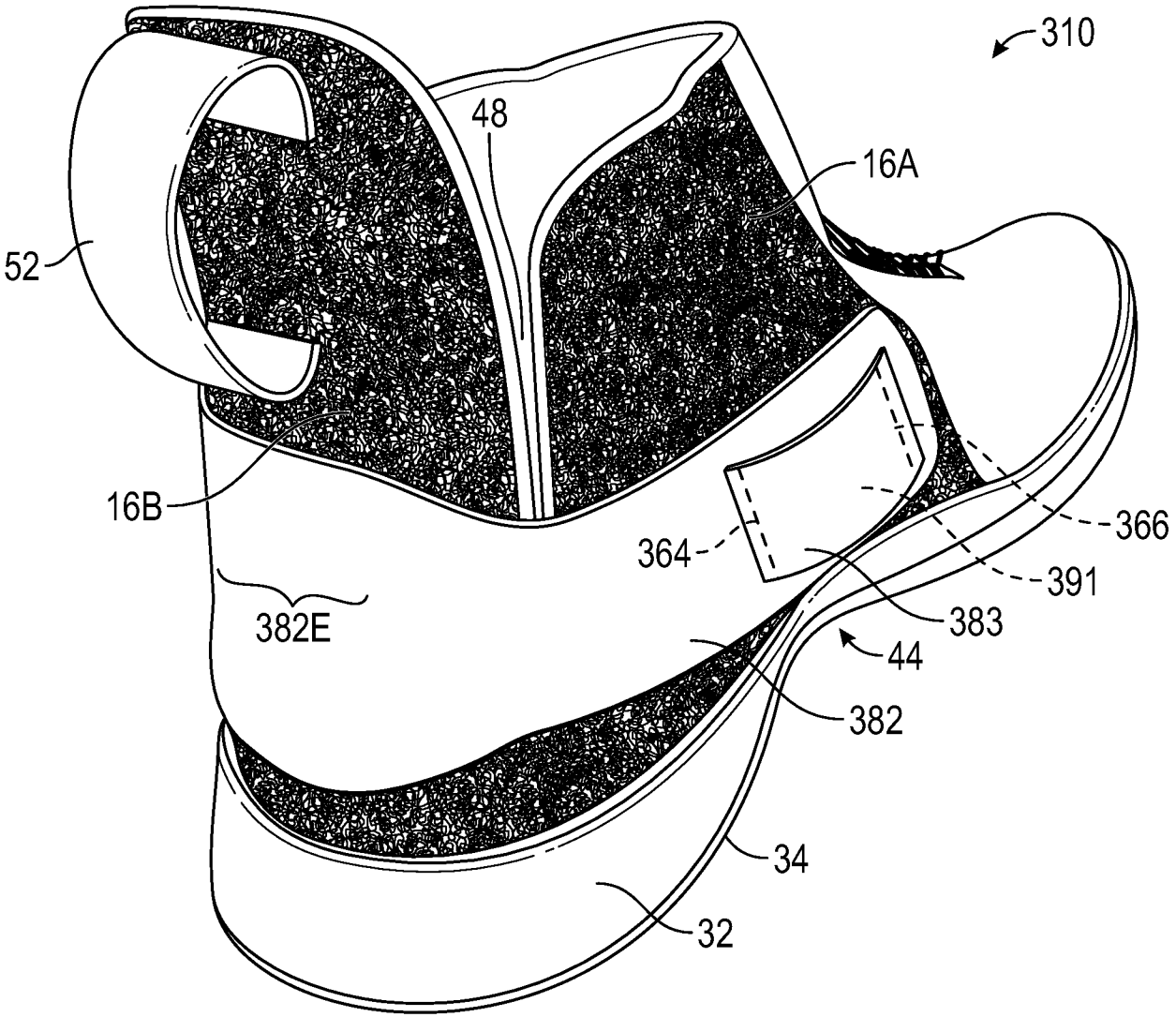
FIG. 12 is a perspective view showing the rear and medial side of an article of footwear with the rear section in the use position and the alternative strap of FIGS. 10-11 in a secured position.
Figure 13:
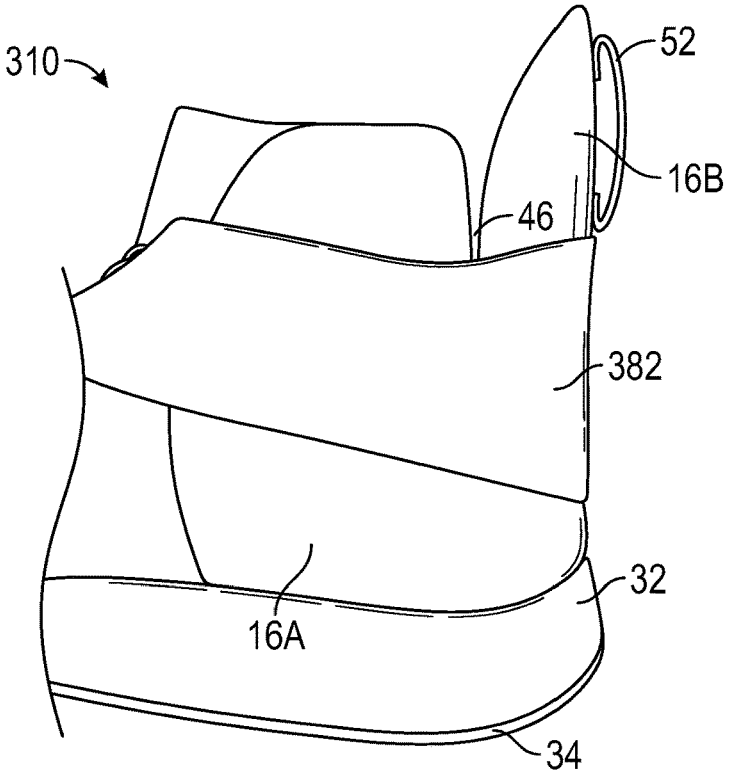
FIG. 13 is a fragmentary lateral side view of the article of footwear of FIG. 12.
Figure 14:
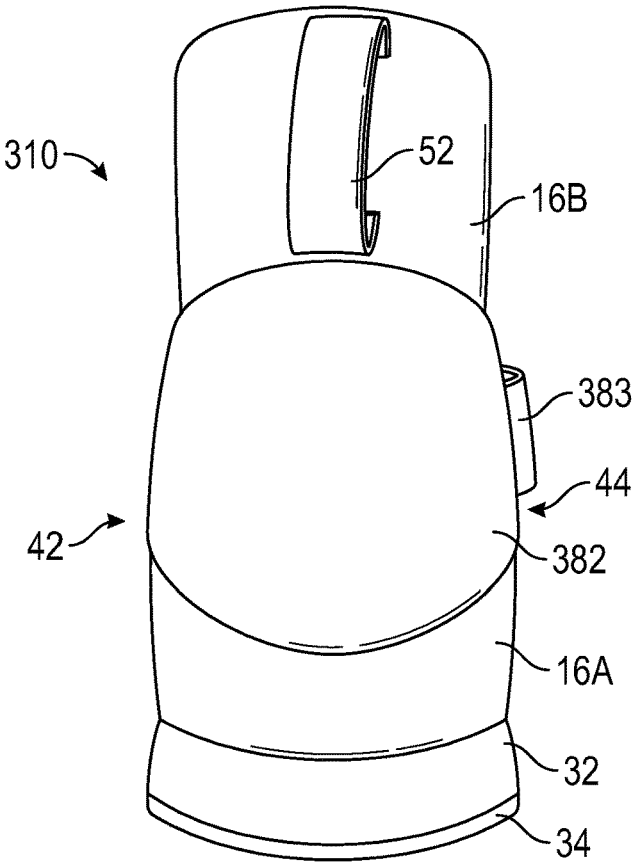
FIG. 14 is a medial side view of the article of footwear of FIG. 12.

FIGS. 10 and 11 show an alternative strap 382 that can be used in place of strap 282 on an article of footwear 310 shown in FIGS. 12-14. Components of the article of footwear 310 that are the same as those in the article of footwear 10, 110 and/or 210 are indicated with like reference numbers. In FIGS. 10 and 11, the strap 382 is shown with the attached cables 256 in fragmentary view and the strap 382 laid flat. As can be seen in FIG. 10, a width of the strap 382 between an upper edge 392 of the strap and a lower edge 390 of the strap varies between the distal end 382C and the proximal end 382D. More specifically, the strap 382 is wider at an intermediate portion 382E of the strap (indicated at width W1) than at a portion (indicated at width W2) between the intermediate portion 382E and the proximal end 382D and also wider at the intermediate portion 382E than at a portion (indicated at width W3) between the intermediate portion 382E and the distal end 382C where all widths are measured perpendicular to a longitudinal midline ML of the strap 382.

Fasteners are disposed on the strap 382 and on the upper 16 to provide a desirable combination of support at both the medial side 44 and the lateral side 42 of the front section 16A, while still enabling adjustability in the tightness and position of the strap 382. More specifically, fasteners include fasteners 385, 385A, 385B on the strap 382 that cooperate with fasteners 286A, 286B, 286C on the upper 16 to help releasably secure the strap 382 to the front section 16A and to the rear section 16B so that the strap 382 can maintain the rear section 16B in the use position. The fasteners 385, 385A, 385B are secured to the inner side of the strap 382 and may be referred to as a series of fastener portions. The fasteners 385, 385A, and 385B, may be hook-and-loop fasteners. The fasteners 385, 385A, 385B may be hooks, and the fasteners 286A, 286B, and 286C may be loops. Alternatively, the fasteners 385, 385A, and 385B could be loops, and the fasteners 286A, 286B, and 286C could be hooks, some of the fasteners 385, 385A, and 385B could be hooks and some could be loops, while some of the fasteners 286A, 286B, and 286C could be hooks and others could be loops, or one or more of the fasteners 385, 385A, and 385B could be a combination of hooks and loops, and one or more of the fasteners 286A, 286B, and 286C could be a combination of hooks and loops. Still further, other types of fasteners could be used, such as snaps, buttons, etc.

As best shown in FIG. 11, the plurality of first fasteners 385, 385A, and 385B are spaced along the inner side 395 of the strap 382, which enables a greater variation in positioning of the strap 382 on the upper 16 in the secured state of the strap 382. Spacing multiple first fasteners 385A along the strap 382 may allow greater articulation of the strap 382 if the material of the strap 382 has greater flexibility than the material of the fasteners 385A. Given that the first fasteners 385A are configured as strips arranged parallel with one another and will extend vertically between a bottom edge 390 of the strap 382 and a top edge 392 of the strap 382 when the strap 382 is releasably secured as shown in FIG. 12, the strap 382 is better able to articulate to extend around the rear of the rear section 16B from the lateral side 42 to the medial side 44. The fasteners 385B are rounded rather than strips, which may provide a larger locating area to help with an initial pressing against and securing of the strap 382 at the medial side 44 to maintain the tension in the cables 256. The fastener 385 is also circular but could be other shapes.

The strap 382, the cables 256 and the upper 16 are sized so that the widest portion of the strap 382 (e.g., the intermediate portion 382E) is disposed against and extends across the rear section 16B when the rear section 16B is in the use position and the strap 382 is releasably secured, as shown in FIGS. 12-14, to provide increased lateral support and stability to the wearer's heel. As shown in FIG. 12, the strap 382 fits entirely below the looped tab 52 against the rear section 16B when secured to the front section 16A even though the widest portion (the intermediate portion 382E) is disposed at the rear section 16B. This variation in width causes the strap 382 to be convex along the upper edge 392 of the strap 382 at the intermediate portion 382E and convex along the lower edge 390 of the strap 382 at the intermediate portion 382E. FIG. 13 shows the strap 382 extending across the lateral slit 46 on the lateral side 42 and FIG. 12 shows the strap 382 extends across the medial slit 48 and the lateral slit 46.

With reference to FIG. 10, unlike the looped handle 283 of the article of footwear 210, the looped handle 383 extends along the length (e.g., the longitudinal midline LM) of the strap 382 between a first location 364 and a second location 366 at which it is stitched or otherwise secured to the strap 382, and an opening 391 is formed by the looped handle 383 and the strap 382 between the first location 364 and the second location 366. The opening 391 extends perpendicular to the length of the strap 382. The looped handle 383 extends between the first location 364 and the second location 366 (e.g., from the first location 364 to the second location 366) without connection to the strap 382 between the locations 364, 366.

Figure 15:
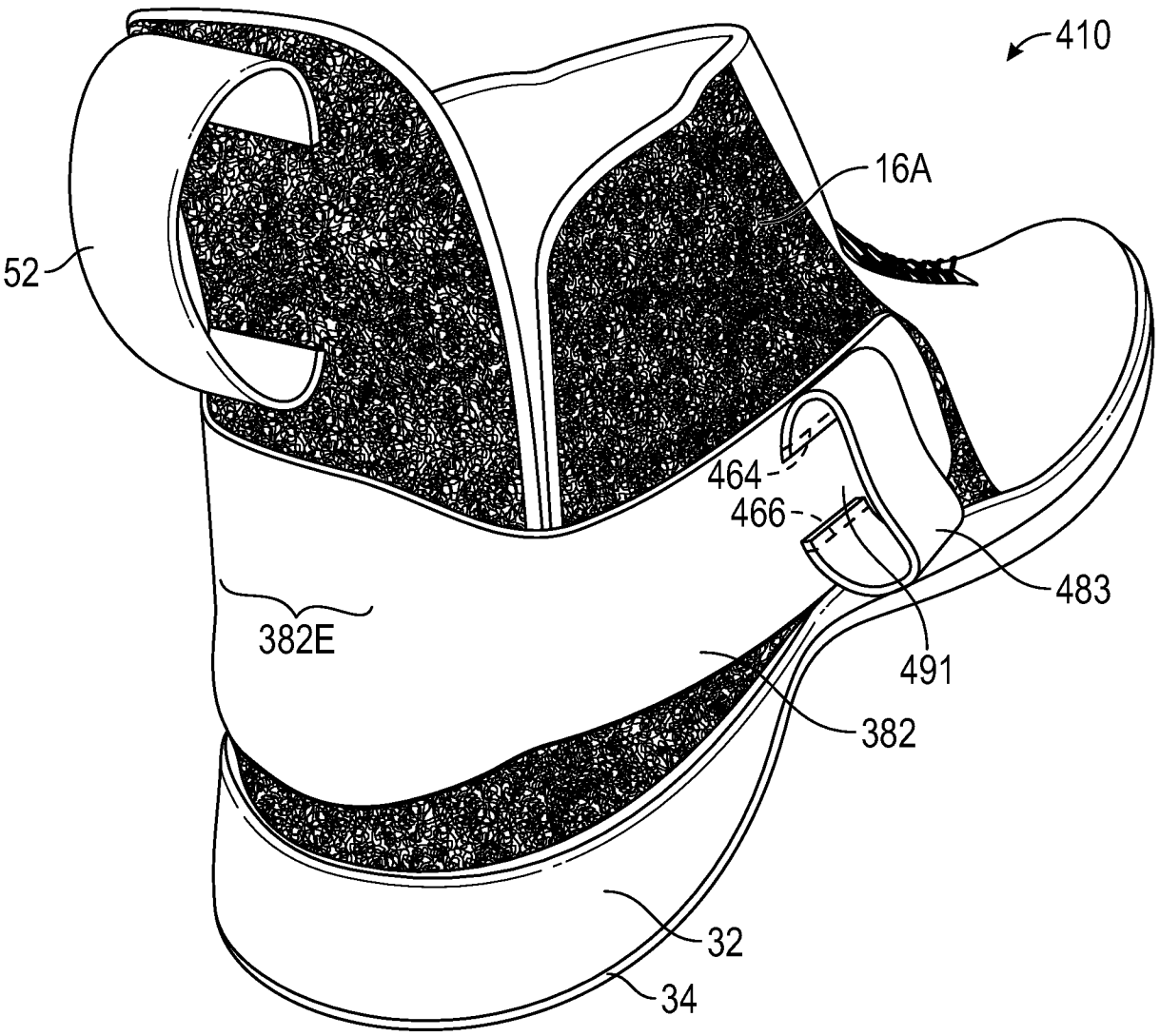
FIG. 15 is a fragmentary rear perspective view showing the rear and medial side of an article of footwear with the alternative strap of FIGS. 10-11 in a secured position and with an alternative looped handle on the strap.

FIG. 15 shows another embodiment of an article of footwear 410 alike in all aspects to article of footwear 310 except that a looped handle 483 used in place of looped handle 383 is secured to the strap 382 at a first location 464 above the second location 466 so that an opening 491 between the looped handle 483 and the strap 382 extends along the length of the strap 382 (e.g., horizontally). The opening 491 extends parallel to the length of the strap 382. The looped handle 483 extends between the first location 464 and the second location 466 (e.g., from the first location 464 to the second location 466) without connection to the strap 382 between the locations 464, 466.

The following Clauses provide example configurations of an article of footwear disclosed herein.

Clause 1: An article of footwear comprising: a sole structure; an upper including a first section and a second section and partially defining a foot-receiving cavity over the sole structure; wherein the first section is fixed to the sole structure and the second section articulates between an access position and a use position, the foot-receiving cavity being more exposed in the access position than in the use position; a strap extending from one of the first section and the second section; a looped handle extending from the strap and at least partially forming a loop; and wherein the strap extends across the second section of the upper when the second section is in the use position; and wherein the strap has a distal portion configured to releasably secure to one of the first section or the second section with the looped handle exposed.

Clause 2: The article of footwear of Clause 1, wherein the looped handle is attached to the strap at a first location and at a second location spaced apart from the first location, and the looped handle extends between the first location and the second location without connection to the strap.

Clause 3: The article of footwear of Clause 2, wherein the looped handle extends along the length of the strap from the first location to the second location, and an opening formed by the looped handle and the strap between the first location and the second location extends perpendicular to the length of the strap.

Clause 4: The article of footwear of any of Clauses 1-3, wherein the distal portion of the strap releasably secures to one of the first section or the second section nearer to a distal end of the strap than to a proximal end of the strap.

Clause 5: The article of footwear of Clause 4, wherein the looped handle is disposed nearer to the distal end of the strap than to the proximal end of the strap.

Clause 6: The article of footwear of Clause 4, further comprising: a first fastener portion secured to the strap nearer to the distal end of the strap than to the proximal end of the strap; a second fastener portion secured to the one of the first section or the second section; and wherein the first fastener portion is configured to releasably secure to the second fastener portion.

Clause 7: The article of footwear of Clause 6, wherein the first fastener portion is secured to an inner side of the strap and the looped handle is secured to an outer side of the strap.

Clause 8: The article of footwear of Clause 7, wherein the first fastener portion is secured to the strap directly opposite from the looped handle.

Clause 9: The article of footwear of any of Clauses 1-8, wherein a width of the strap between an upper edge of the strap and a lower edge of the strap varies between the distal end and the proximal end.

Clause 10: The article of footwear of Clause 9, wherein: the strap is wider at an intermediate portion of the strap than between the proximal end and the intermediate portion and than between the distal end and the intermediate portion; and the intermediate portion of the strap is disposed against the second section when the strap is releasably secured to the one of the first section or the second section.

Clause 11: The article of footwear of Clause 9, wherein the strap is convex along the upper edge of the strap at the intermediate portion and convex along the lower edge of the strap at the intermediate portion.

Clause 12: The article of footwear of any of Clauses 1-11, further comprising: a series of fasteners spaced apart from one another along an inner side of the strap.

Clause 13: The article of footwear of Clause 12, wherein the series of fasteners along the inner side of the strap is configured as elongated strips disposed with lengths of the elongated strips extending perpendicular to a length of the strap.

Clause 14: The article of footwear of Clause 13, wherein an exterior surface of the second section comprises a hook-and-loop material and the series of fasteners are hook-and-loop fasteners configured to secure to the hook-and-loop material of the second section.

Clause 15: The article of footwear of any of Clauses 1-14, wherein: the upper defines a medial slit and a lateral slit both bounding the second section and both extending downward from an upper edge of the upper partway to the sole structure; and the strap extends across the medial slit and the lateral slit when releasably secured to the first section.

Clause 16: The article of footwear of Clause 15, wherein: the second section has a fold region extending across the second section between a lowest extent of the medial slit and a lowest extent of the lateral slit; and the second section is thinner at the fold region than above the fold region and than below the fold region, the second section articulating at the fold region from the use position to the access position.

Clause 17: The article of footwear of Clause 16, wherein: the first section is a front section fixed to a forefoot region of the sole structure; and the second section is disposed at a heel region of the sole structure at least partially rearward of the first section.

Clause 18: The article of footwear of any of Clauses 1-17, further comprising: a plurality of tensioning cables fixed to at least one of the upper or the sole structure at a first side of the first section and extending out of the first section of the upper and secured to the strap; a plurality of looped cables fixed to at least one of the upper or the sole structure at a second side of the first section; and wherein the plurality of tensioning cables extends through the plurality of looped cables.

Clause 19: The article of footwear of Clause 18, wherein the strap is non-releasably connected to the upper only by the plurality of cables.

Clause 20: The article of footwear of Clause 18, further comprising: a fastener disposed at the first side of the first section; and wherein the strap is configured to releasably secure to the fastener at the first side of the first section to maintain tension in the tensioning cables prior to releasably securing to the second side of the first section.

Clause 21: The article of footwear of Clause 2, wherein the looped handle extends along the width of the strap from the first location to the second location, and an opening formed by the looped handle and the strap between the first location and the second location extends parallel to the length of the strap.

Clause 22: An article of footwear comprising: a sole structure; an upper including a first section and a second section and partially defining a foot-receiving cavity over the sole structure; wherein the first section is fixed to the sole structure and the second section articulates between an access position and a use position, the foot-receiving cavity being more exposed in the access position than in the use position; a strap extending from one of the first section and the second section; a looped handle extending from the strap and at least partially forming a loop; and wherein the strap extends across the second section of the upper when the second section is in the use position; and wherein the strap has a distal portion configured to releasably secure to one of the first section or the second section with the looped handle exposed.

Clause 23: The article of footwear of Clause 22, wherein the looped handle is attached to the strap at a first location and at a second location spaced apart from the first location, and the looped handle extends between the first location and the second location without connection to the strap.

Clause 24: The article of footwear of Clause 23, wherein the looped handle extends along the length of the strap between the first location and the second location, and an opening formed by the looped handle and the strap between the first location and the second location extends perpendicular to the length of the strap.

Clause 25: The article of footwear of any of Clauses 22-24, wherein the distal portion of the strap releasably secures nearer to a distal end of the strap than to a proximal end of the strap.

Clause 26: The article of footwear of Clause 25, wherein the looped handle is disposed nearer to the distal end of the strap than to the proximal end of the strap.

Clause 27: The article of footwear of Clause 25, further comprising: a first fastener portion secured to the strap nearer to the distal end of the strap than to the proximal end of the strap; a second fastener portion secured to the one of the first section or the second section; and wherein the first fastener portion is configured to releasably secure to the second fastener portion.

Clause 28: The article of footwear of Clause 27, wherein the first fastener portion is secured to an inner side of the strap and the looped handle is secured to an outer side of the strap.

Clause 29: The article of footwear of Clause 28, wherein the first fastener portion is secured to the strap directly opposite from the looped handle.

Clause 30: The article of footwear of any of Clauses 22-29, wherein a width of the strap between an upper edge of the strap and a lower edge of the strap varies between the distal end and the proximal end.

Clause 31: The article of footwear of Clause 30, wherein: the upper includes a first section and a second section; the first section is fixed to the sole structure and the second section articulates between an access position and a use position, the foot-receiving cavity being more exposed in the access position than in the use position; the strap extends across the second section when the second section is in the use position; the strap is wider at an intermediate portion of the strap than between the proximal end and the intermediate portion and than between the distal end and the intermediate portion; and the intermediate portion of the strap is disposed against the second section when the strap is releasably secured to the one of the first section or the second section.

Clause 32: The article of footwear of Clause 30, wherein the strap is convex along the upper edge of the strap at the intermediate portion and convex along the lower edge of the strap at the intermediate portion.

Clause 33: The article of footwear of any of Clauses 22-32, further comprising: a series of fasteners spaced apart from one another along an inner side of the strap.

Clause 34: The article of footwear of Clause 33, wherein the series of fasteners along the inner side of the strap is configured as elongated strips disposed with lengths of the elongated strips extending perpendicular to a length of the strap.

Clause 35: The article of footwear of Clause 34, wherein: the upper includes a first section and a second section; the first section is fixed to the sole structure and the second section articulates between an access position and a use position, the foot-receiving cavity being more exposed in the access position than in the use position; the strap extends across the second section when the second section is in the use position; an exterior surface of the second section comprises a hook-and-loop material and the series of fasteners are hook-and-loop fasteners configured to secure to the hook-and-loop material of the second section.

Clause 36: The article of footwear of any of Clauses 22-35, wherein: the upper includes a first section and a second section; the first section is fixed to the sole structure and the second section articulates between an access position and a use position, the foot-receiving cavity being more exposed in the access position than in the use position; the strap extends across the second section when the second section is in the use position; the upper defines a medial slit and a lateral slit both bounding the second section and both extending downward from an upper edge of the upper partway to the sole structure; and the strap extends across the medial slit and the lateral slit when releasably secured to the first section.

Clause 37: The article of footwear of Clause 36, wherein: the second section has a fold region extending across the second section between a lowest extent of the medial slit and a lowest extent of the lateral slit; and the second section is thinner at the fold region than above the fold region and than below the fold region, the second section articulating at the fold region from the use position to the access position.

Clause 38: The article of footwear of Clause 37, wherein: the first section is a front section fixed to a forefoot region of the sole structure; and the second section is disposed at a heel region of the sole structure at least partially rearward of the first section.

Clause 39: The article of footwear of any of Clauses 22-38, wherein: the upper includes a first section and a second section; the first section is fixed to the sole structure and the second section articulates between an access position and a use position, the foot-receiving cavity being more exposed in the access position than in the use position; the strap extends across the second section when the second section is in the use position; the article of footwear further comprising: a plurality of tensioning cables fixed to at least one of the upper or the sole structure at a first side of the first section and extending out of the first section of the upper and secured to the strap; a plurality of looped cables fixed to at least one of the upper or the sole structure at a second side of the first section; and wherein the plurality of tensioning cables extends through the plurality of looped cables.

Clause 40: The article of footwear of Clause 39, wherein the strap is non-releasably connected to the upper only by the plurality of cables.

Clause 41: The article of footwear of Clause 39, further comprising: a fastener disposed at the first side of the first section; and wherein the strap is configured to releasably secure to the fastener at the first side of the first section to maintain tension in the tensioning cables prior to releasably securing to the second side of the first section.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure;

an upper including a first section and a second section and partially defining a foot-receiving cavity over the sole structure;

wherein the upper defines a medial slit and a lateral slit both bounding the second section and both extending downward from an upper edge of the upper partway to the sole structure;

wherein the first section is fixed to a forefoot region of the sole structure, the second section is disposed at a heel region of the sole structure at least partially rearward of the first section, and the second section articulates between an access position and a use position, the foot-receiving cavity being more exposed in the access position than in the use position;

a strap extending from one of the first section and the second section; and a looped handle extending from the strap at an outer side of the strap and at least partially forming a loop;

wherein the strap is movable via the looped handle at the outer side of the strap to extend across the second section of the upper when the second section is in the use position;

wherein the strap has a distal portion configured to releasably secure to one of the first section or the second section with the looped handle exposed at the outer side of the strap when the distal portion is releasably secured to the one of the first section or the second section;

wherein the strap extends across the medial slit and the lateral slit when releasably secured to the first section;

wherein the second section has a fold region extending across the second section between a lowest extent of the medial slit and a lowest extent of the lateral slit;

wherein the fold region is above a lower extent of the second section and below an upper extent of the second section;

wherein the second section is thinner at the fold region than above the fold region and than below the fold region; and wherein the second section articulates at the fold region from the use position to the access position, and the upper extent of the second section articulates downward and rearward from the use position to the access position.

2. The article of footwear of claim 1, wherein the looped handle is attached to the strap at a first location and at a second location spaced apart from the first location, and the looped handle extends between the first location and the second location without connection to the strap.

3. The article of footwear of claim 2, wherein the looped handle extends along a length of the strap from the first location to the second location, and an opening formed by the looped handle and the strap between the first location and the second location extends perpendicular to the length of the strap.

4. The article of footwear of claim 2, wherein the looped handle extends along a width of the strap from the first location to the second location, and an opening formed by the looped handle and the strap between the first location and the second location extends parallel to a length of the strap.

5. The article of footwear of claim 1, wherein the distal portion of the strap releasably secures to one of the first section or the second section nearer to a distal end of the strap than to a proximal end of the strap and the looped handle is disposed nearer to the distal end of the strap than to the proximal end of the strap.

6. The article of footwear of claim 5, further comprising:

a first fastener portion secured to the strap nearer to the distal end of the strap than to the proximal end of the strap; and a second fastener portion secured to the one of the first section or the second section;

wherein the first fastener portion is configured to releasably secure to the second fastener portion.

7. The article of footwear of claim 6, wherein the first fastener portion is secured to an inner side of the strap.

8. The article of footwear of claim 7, wherein the first fastener portion is secured to the strap directly opposite from the looped handle.

9. The article of footwear of claim 1, wherein a width of the strap between an upper edge of the strap and a lower edge of the strap varies between the distal end of the strap and a proximal end of the strap.

10. The article of footwear of claim 9, wherein:

the strap is wider at an intermediate portion of the strap than between the proximal end and the intermediate portion and than between the distal end and the intermediate portion when the intermediate portion of the strap is disposed against the second section and the strap is tensioned in a longitudinal direction of the strap and releasably secured to the one of the first section or the second section.

11. The article of footwear of claim 10, wherein the strap is convex along the upper edge of the strap at the intermediate portion and convex along the lower edge of the strap at the intermediate portion when the intermediate portion of the strap is disposed against the second section and the strap is tensioned in a longitudinal direction of the strap and releasably secured to the one of the first section or the second section.

12. The article of footwear of claim 1, further comprising:

a series of fasteners spaced apart from one another along an inner side of the strap.

13. The article of footwear of claim 12, wherein the series of fasteners along the inner side of the strap is configured as elongated strips disposed with lengths of the elongated strips extending perpendicular to a length of the strap.

14. The article of footwear of claim 13, wherein an exterior surface of the second section comprises a hook-and-loop material and the series of fasteners are hook-and-loop fasteners configured to secure to the hook-and-loop material of the second section.

15. The article of footwear of claim 1, further comprising:

a plurality of tensioning cables fixed to at least one of the upper or the sole structure at a first side of the first section and extending out of the first section of the upper and secured to the strap; and a plurality of looped cables fixed to at least one of the upper or the sole structure at a second side of the first section;

wherein the plurality of tensioning cables extends through the plurality of looped cables.

16. The article of footwear of claim 15, wherein the strap is non-releasably connected to the upper only by the plurality of tensioning cables.

17. The article of footwear of claim 15, further comprising:

a fastener disposed at the first side of the first section; and an additional fastener disposed at the second side of the first section;

wherein the strap is configured to releasably secure to the fastener at the first side of the first section to maintain tension in the tensioning cables prior to extending across a rear of the second section and releasably securing to the additional fastener at the second side of the first section.

* * * * *